US010141093B2

(12) United States Patent
Inaba et al.

(10) Patent No.: US 10,141,093 B2
(45) Date of Patent: Nov. 27, 2018

(54) REACTOR

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Kazuhiro Inaba, Yokkaichi (JP); Shinichirou Yamamoto, Yokkaichi (JP); Masayuki Kato, Yokkaichi (JP); Yukinori Yamada, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 53 days.

(21) Appl. No.: 15/107,734

(22) PCT Filed: Dec. 22, 2014

(86) PCT No.: PCT/JP2014/083975
§ 371 (c)(1),
(2) Date: Jun. 23, 2016

(87) PCT Pub. No.: WO2015/098876
PCT Pub. Date: Jul. 2, 2015

(65) Prior Publication Data

US 2016/0322150 A1 Nov. 3, 2016

(30) Foreign Application Priority Data

Dec. 26, 2013 (JP) ..... 2013-270518
Oct. 2, 2014 (JP) ..... 2014-204354

(51) Int. Cl.
*H01F 27/08* (2006.01)
*H01F 37/00* (2006.01)
(Continued)

(52) U.S. Cl.
CPC ..... *H01F 27/08* (2013.01); *H01F 27/2823* (2013.01); *H01F 27/2876* (2013.01);
(Continued)

(58) Field of Classification Search
CPC ..... H01F 27/00–27/36
(Continued)

(56) References Cited

U.S. PATENT DOCUMENTS 5,469,124 A * 11/1995 O'Donnell ..... H01F 27/06 336/210
6,492,890 B1 * 12/2002 Woznlczka ..... H01F 27/22 336/198
(Continued)

FOREIGN PATENT DOCUMENTS

JP 2000-100633 A 4/2000
JP 2001-210530 A 8/2001
(Continued)

OTHER PUBLICATIONS

Feb. 3, 2015 Search Report issued in International Patent Application No. PCT/JP2014/083975.

*Primary Examiner* — Tuyen Nguyen
(74) *Attorney, Agent, or Firm* — Oliff PLC

(57) ABSTRACT

A reactor that includes a coil made of a wound coil wire; a magnetic core on which the coil is arranged, and that forms a closed magnetic path, wherein the magnetic core has an inner core section that is arranged on an inside of the coil; and a heat dissipating sheet that is interposed at least partially between an inner circumferential surface of the coil and an outer circumferential surface of the inner core section
(Continued)

that is opposite to the inner circumferential surface of the coil, wherein the heat dissipating sheet is in contact with the coil and the inner core section.

9 Claims, 12 Drawing Sheets

(51) Int. Cl.
*H01F 27/28* (2006.01)
*H01F 27/30* (2006.01)
*H01F 27/32* (2006.01)
*H01F 27/26* (2006.01)

(52) U.S. Cl.
CPC ..... *H01F 27/306* (2013.01); *H01F 27/324* (2013.01); *H01F 37/00* (2013.01); *H01F 27/263* (2013.01)

(58) Field of Classification Search
USPC ..... 336/65, 83, 90–96, 200, 210–212, 336/220–223, 233–234
See application file for complete search history.

(56) References Cited

U.S. PATENT DOCUMENTS

| | | | | |
|---|---|---|---|---|
| 6,600,402 | B1 * | 7/2003 | LaFleur | H01F 27/22 336/198 |
| 8,493,167 | B2 * | 7/2013 | Kim | H01F 27/085 336/61 |
| 2009/0002110 | A1 * | 1/2009 | Ahangar | H01F 27/10 336/60 |
| 2011/0156853 | A1 * | 6/2011 | Kato | H01F 27/306 336/192 |
| 2012/0092120 | A1 * | 4/2012 | Yoshikawa | H01F 27/022 336/220 |
| 2013/0088317 | A1 | 4/2013 | Tawara et al. | |

FOREIGN PATENT DOCUMENTS

| | | | |
|---|---|---|---|
| JP | 2010-278384 | A | 12/2010 |
| JP | 2013-084767 | A | 5/2013 |
| JP | 2013-135191 | A | 7/2013 |
| JP | 2013-179186 | A | 9/2013 |

* cited by examiner

10: 2, 3
2: 2a, 2b
3: 31, 32
31: 31b, 31c
32: 32b, 32c

32:32b, 32c

REACTOR

BACKGROUND

The present disclosure relates to a reactor that is used in, for example, constituent components of in-car DC-DC converters or electric power conversion systems that are installed in vehicles such as hybrid automobiles. The present disclosure particularly relates to a reactor that has excellent heat-dissipation performance.

Reactors are one of the components of circuits for increasing or decreasing an electric voltage. For example, JP 2013-135191A and JP 2013-84707A disclose, as reactors for use in a converter that is installed in vehicles such as hybrid automobiles, reactors that include a coil made of a wound coil wire, and an annular magnetic core on which the coil is arranged.

JP 2013-135191A discloses a reactor that includes a coil, and a magnetic core including an inner core section that is arranged on the inside of the coil, and outer core sections that are exposed from the coil, the reactor having a configuration in which an assembly of the coil and the magnetic core is arranged on a heatsink. The inner core section is a stacked body in which divided cores (core pieces) and gap plates are alternately stacked. The core pieces may be a molded body made of magnetic powder or a stacked body in which a plurality of magnetic thin plates (for example, electromagnetic steel sheets) are stacked. Furthermore, a pair of inner bobbins are arranged on the outer circumference of the inner core section in order to enhance the insulation between the coil and the inner core section, JP 2013-135191A discloses that by fixing and mounting the heatsink on which the assembly is installed to a cooling base to which the reactor is to be installed, the heatsink is used as a heat dissipation path from the assembly to the cooling base, and thereby the heat-dissipation performance of the reactor is improved.

JP 2013-84767A discloses that an inner core is a stacked body in which core divisions (core pieces) and gap plates are alternately stacked, in which the core divisions and the gap plates are adhered to each other with a cyanoacrylate adhesive, and the inner core is thrilled as a single piece by insert molding of a thermoplastic resin.

SUMMARY

In recent years, reactors for use in hybrid automobiles and the like are likely to be subjected to high frequencies and high currents, and thus heat that is generated in coils and magnetic cores of reactors is likely to increase. If the coil and the magnetic core do not sufficiently dissipate the heat, there will be the risk that the reactor operates unreliably.

In conventional reactors, the heat generated in the coil and the magnetic core is transferred to a heatsink or the like on which the assembly is placed, and is dissipated to the outside (installation target). Because the inner core section of the magnetic core is provided with the bobbins on the outer circumference of the inner core section, or is covered with a resin, the heat generated in the inner core section will be transferred to the outer core sections, and will be dissipated mainly via the outer core sections. However, because a heat dissipation path from the inner core section to each outer core section is long, it is difficult for the heat of the inner core section to be transferred to the outer core section and be dissipated, and the temperature of the inner core section tends to increase. Particularly, the temperature increase is significant in the vicinity of an intermediate part of the inner core section arranged between the pair of outer core sections. Furthermore, the gap plates are ordinarily made of a resin, and thus have a low thermal conductivity. Therefore, in the case where the inner core section has a configuration in which core pieces and gap plates are alternately stacked, the gap plates will serve as a factor for preventing the heat transfer, and it is thus difficult for the heat to be transferred from the core pieces between the gap plates to the outer core sections and be dissipated from the inner core section. Accordingly, there is a demand for improving the heat-dissipation performance of the inner core section and developing a reactor that has excellent heat-dissipation performance.

Accordingly, an exemplary aspect of the present disclosure provides a reactor that has excellent heat-dissipation performance.

According to an exemplary aspect of the present disclosure, a reactor includes a coil made of a wound coil wire, a magnetic core on which the coil is arranged and that forms a closed magnetic path, wherein the magnetic core has an inner core section that is arranged on an inside of the coil, and a heat dissipating sheet that is interposed at least partially between an inner circumferential surface of the coil and an outer circumferential surface of the inner core section that is opposite to the inner circumferential surface of the coil, wherein the heat dissipating sheet is in contact with the coil and the inner core section.

The above-described reactor has excellent heat-dissipation performance.

DETAILED DESCRIPTION OF EMBODIMENTS

Illustration of Embodiments of Disclosure

Figure 1:
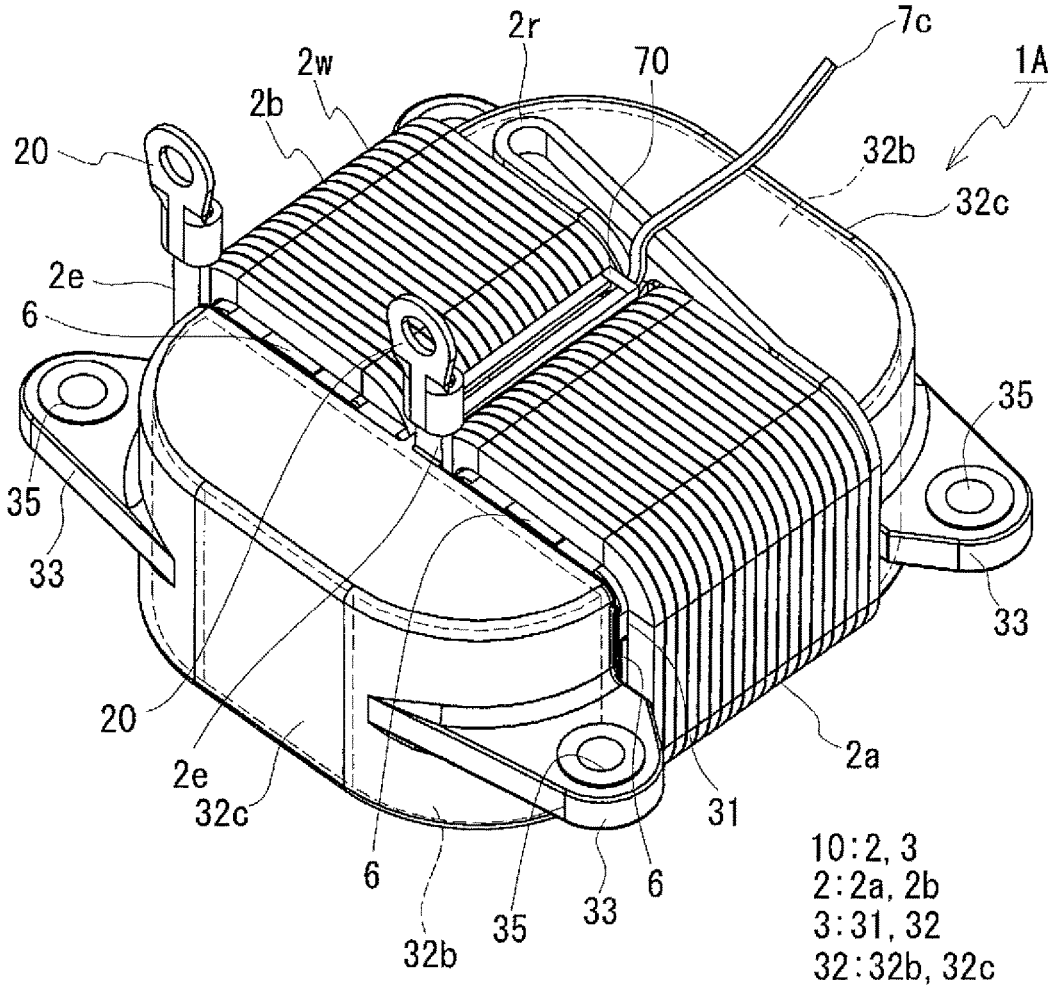
FIG. 1 is a perspective view schematically illustrating a reactor according to Embodiment 1.

First, embodiments of the present disclosure will be described in order.

(1) The reactor according to an exemplary aspect of the present disclosure includes a coil made of a wound coil wire, and a magnetic core on which the coil is arranged and that forms a closed magnetic path. The magnetic core has an inner core section that is arranged on the inside of the coil. Also, the reactor is provided with a heat dissipating sheet that is interposed at least partially between an inner circumferential surface of the coil and an outer circumferential surface of the inner core section that is opposite to the inner circumferential surface of the coil and the heat dissipating sheet is in contact with the coil and the inner core section.

By the heat dissipating sheet being interposed between the coil and the inner core section so as to be in contact therewith, the reactor can transfer the heat of the inner core section to the coil via the heat dissipating sheet, and can dissipate the heat via the coil. In other words, it is possible to ensure the heat dissipation path from the inner core section to the coil. Accordingly, the reactor can improve the heat-dissipation performance of the inner core section, and has superior the heat-dissipation performance.

(2) According to an exemplary aspect of the reactor, the heat dissipating sheet may be arranged on at least a part of an installation target-side surface of the outer circumferential surface of the inner core section, the installation target-side surface being opposite to an installation target.

According to the above-described aspect, by the heat dissipating sheet being arranged on the installation target-side surface, a heat dissipation path from the inner core section to the installation target via the coil is formed, making it possible to shorten the heat dissipation path from the inner core section to the installation target. Accordingly, the heat of the inner core section is easily transferred to the installation target (such as, for example, a cooling base) via the coil, and can efficiently be dissipated, making it possible to enhance the heat-dissipation performance.

(3) According to an exemplary aspect of the reactor, the heat dissipating sheet may be made of an elastic material, and may be elastically deformed while being sandwiched between the coil and the inner core section.

Conventionally, a reactor has an configuration in which, for example, an assembly of a core and a coil ifs accommodated in a case, and the case is filled with a sealing material, or the periphery of the assembly is molded with a resin. However, it has been considered to omit the sealing material or the molded resin in view of downsizing, light-weighting, and a cost reduction of the reactor. Alternatively, as another configuration, it has also been proposed that the reactor is immersed in a liquid coolant, and is forcibly cooled by the liquid coolant by circulation of the liquid coolant. In this case, if the coil is covered with a sealing material or a molded resin, the coil will not be able to get into direct contact with the liquid coolant, and it can be considered to omit the sealing material or the molded resin in view of enhancement of the heat dissipation effect by the liquid coolant. However, if the sealing material or the molded resin is omitted, the coil will not be fixed to the core, and the coil may be moved in the axial direction, the radial direction, or the circumferential direction due to vibration of the coil or the core at the time of operation of the reactor, influence of the outer environment, or the like. If the coil is moved with respect to the core, the coil may collide or rub against the core, or adjacent turns of the coil may collide or rub against each other, causing noise. Furthermore, if a coated wire is used for the coil, there will be a risk that the insulating coating of the coil is damaged due to the collision or rubbing against the core, or the collision or rubbing of the turns, or the like.

According to the above aspect, a heat dissipating sheet is interposed at least partially between the coil and the inner core section while being elastically deformed, and the coil is pressed by the elastic deformation of the heat dissipating sheet. By the heat dissipating sheet pressing the coil, it is possible to restrict the movement of the coil with respect to the inner core section in the axial direction, the radial direction, or the circumferential direction due to vibration of the coil or the magnetic core at the time of operation of the reactor, vibration when the vehicle is driving, or influence of the outer environment (for example, circulation of the liquid coolant), or the like. Since the movement of the coil is restricted, the coil can be suppressed from colliding or rubbing against the magnetic core (the inner core section or an outer core section), or adjacent turns of the coil can be suppressed from colliding or rubbing against each other. Accordingly, it is possible to reduce noise resulting from the collision or rubbing, and damage of the insulating coating of the coil. Furthermore, since the heat dissipating sheet is sandwiched between the coil and the inner core section while being elastically deformed, it is possible to prevent the heat dissipating sheet from being displaced even if the heat dissipating sheet (elastic material) does not have adhesivity, or is not adhered to the coil or the inner core section with an adhesive.

Moreover, since the heat dissipating sheet is made of an elastic material, the heat dissipating sheet can be in intimate contact with the inner circumferential surface of the coil or the outer circumferential surface of the inner core section, exerting a high dissipation effect. According to the above-described aspect, it is therefore possible to achieve, with the heat dissipating sheet, both fixation of the coil and improvement in the heat-dissipation performance of the inner core section.

In the reactor of the above-described aspect, the movement of the coil is restricted by the heat dissipating sheet, and the coil is fixed to the magnetic core. Accordingly, even if a conventional sealing material or a molded resin is omitted, the outer circumferential surface of the coil can be exposed while the coil is fixed. Accordingly, if the reactor is placed at, for example, a position at which a liquid coolant is circulated, the coil can get into direct contact with the liquid coolant, and thus the heat dissipation effect by the liquid coolant is efficiently exerted, making it possible to enhance the heat-dissipation performance of the coil, and thus the heat-dissipation performance of the reactor.

(4) According to an exemplary aspect of the reactor, a coil fixing section that is made of a foamed resin, and restricts movement of the coil using a pressing force caused by volume expansion of the foamed resin may further be included. The coil fixing section is interposed between the inner circumferential surface of the coil, and the outer circumferential surface of the inner core section that is opposite to the inner circumferential surface of the coil, and is disposed on at least a part of that section of the outer circumferential surface of the inner core section on which the heat dissipating sheet is not arranged. The coil fixing section includes an inwardly interposed portion that is interposed between the inner circumferential surface of the coil and the outer circumferential surface of the inner core section, and a turn interposed portion that is interposed between turns of the coil.

According to the above-described aspect, the resin is interposed at least partially between the coil and the inner core section in the state of being foamed, that is, in the volume-expanded state of containing air bubbles. Due to this volume expansion, the coil is pressed. The pressing force of the foamed resin restricts the movement of the coil such as deformation in the radial direction or contraction in the axial direction, and fixes the coil to the inner core section. Furthermore, the suppression of the expansion and contraction of the coil is possible also in view of the fact that part of the foamed resin is interposed between turns of the coil, and the distance between the turns is restricted by the foamed resin. Thus, even if no sealing material or molded resin is provided, the reactor of the above-described aspect in which the foamed resin is provided on the inner circumferential surface of the coil and in the vicinity thereof can restrict the movement of the coil due to the above-described vibration at the time of operation or the like. Even if the foamed resin does not have adhesivity, the movement of the coil can be restricted by the pressing force of the foamed resin, but if the foamed resin has adhesivity, also the adhesivity of the resin itself can let the coil fixing section get into intimate contact with both the coil and the inner core section, and get into intimate contact with the turns, making it possible to firmly fix the coil. That is, as an example of the reactor of the above-described aspect, the reactor may use, for the fixation of the coil, both the pressing force of the foamed resin and the adhesivity of the resin itself. By the reactor of the above-described aspect including the coil fixing section made of a foamed resin, stability of the position of the coil with respect to the magnetic core is improved, and the coil can be suppressed from colliding or rubbing against the magnetic core (the inner core section or the outer core section), or adjacent turns of the coil can be suppressed from colliding or rubbing against each other. Accordingly it is possible to reduce noise resulting from the collision or rubbing, the damage of the insulating coating of the coil.

Moreover, since the coil fixing section is disposed on the section on which the heat dissipating sheet is not arranged, the coil fixing section does not interfere with the heat dissipation by the heat dissipating sheet from the inner core section to the coil. Accordingly the heat of the inner core section can be transferred to the coil by the heat dissipating sheet while the coil fixing section fixes the coil, achieving both fixation of the coil and improvement in the heat-dissipation performance of the inner core section.

The reactor of the above-described aspect can easily be manufactured by, for example, arranging a non-foamed resin between the coil and the inner core section, and then performing a thermal treatment necessary for foam formation. The non-foamed resin has a thickness that is significantly smaller than the thickness of the foamed resin, and can easily be arranged between the coil and the inner core section even if the distance therebetween is small (for example, not greater than 2 mm). At the time of foam formation, part of the resin enters between turns to form the turn interposed portion, and the remaining part thereof forms the inwardly interposed portion. The turn interposed portion also functions as an insulation material between the turns.

(5) According to an exemplary aspect of the reactor, the inner core section may include a middle body section for forming the magnetic path, and a middle resin molded section that covers at least a part of the outer circumferential surface of the middle body section.

According to the above-described aspect, since the inner core section includes the middle resin molded section, it is possible to ensure insulation between the coil and the middle body section. Furthermore, it is possible to protect the middle body section from the outer environment, and to impart corrosion resistance against the outer environment to the middle body section.

(6) According to an exemplary aspect of the reactor, in the inner core section, the installation target-side surface, which is opposite to an installation target, of the outer circumferential surface of the middle body section may be exposed without being covered with the middle resin molded section, and the heat dissipating sheet may be arranged on the installation target-side surface on which the middle body section of the inner core section is exposed.

According to the above-described aspect, the heat dissipating sheet is arranged on the surface on which the middle body section of the inner core section is exposed, and the heat dissipating sheet is in contact with the middle body section. Accordingly, it is possible to directly transfer the heat from the middle body section, which generates the heat, to the coil by the heat dissipating sheet. Furthermore, by the heat dissipating sheet being arranged on the installation target-side surface, the heat dissipation path from the inner core section (middle body section) to the installation target can be shortened, and the absence of the middle resin molded section can also reduce the thermal resistance of the heat dissipation path. Therefore, it is possible to dissipate the heat of the inner core section efficiently, and enhance the heat-dissipation performance.

Details of Embodiment of Disclosure

Hereinafter, specific examples of the reactors according to the embodiments of the present disclosure will be described with reference to the drawings. Note that the present disclosure is defined by the claims without being limited to these examples, and all modifications in the meaning and scope that are equivalent to the claims are intended to be included.

Embodiment 1

Overall Configuration of Reactor

A reactor 1A of Embodiment 1 will be described with reference to FIGS. 1 to 5. The reactor 1A includes an assembly 10 of a coil 2 made of a wound coil wire 2*w* and a magnetic core 3 on which the coil 2 is arranged and which forms a closed magnetic path. The reactor 1A includes heat dissipating sheets 4 (see FIGS. 2A to 3) that are interposed between the coil 2 and inner core sections 31 of the magnetic core 3, and transfer heat generated in the inner core sections 31 to the coil 2. The following will describe configurations of the characteristic parts and associated parts of the reactor 1A, and their main effects in order, and will then describe the details of the configurations. Note that in the following description, for sake of convenience, "lower side" refers to the side of the object to which the reactor is installed, or the "installation target side" of the reactor 1A (assembly 10), and "upper side" refers to a side opposite thereto. Furthermore, the same reference numerals in the drawings indicate components of the same name.

Configurations of Main Characteristic Parts and Associated Parts Assembly

Coil

Figures 2A, 2B:
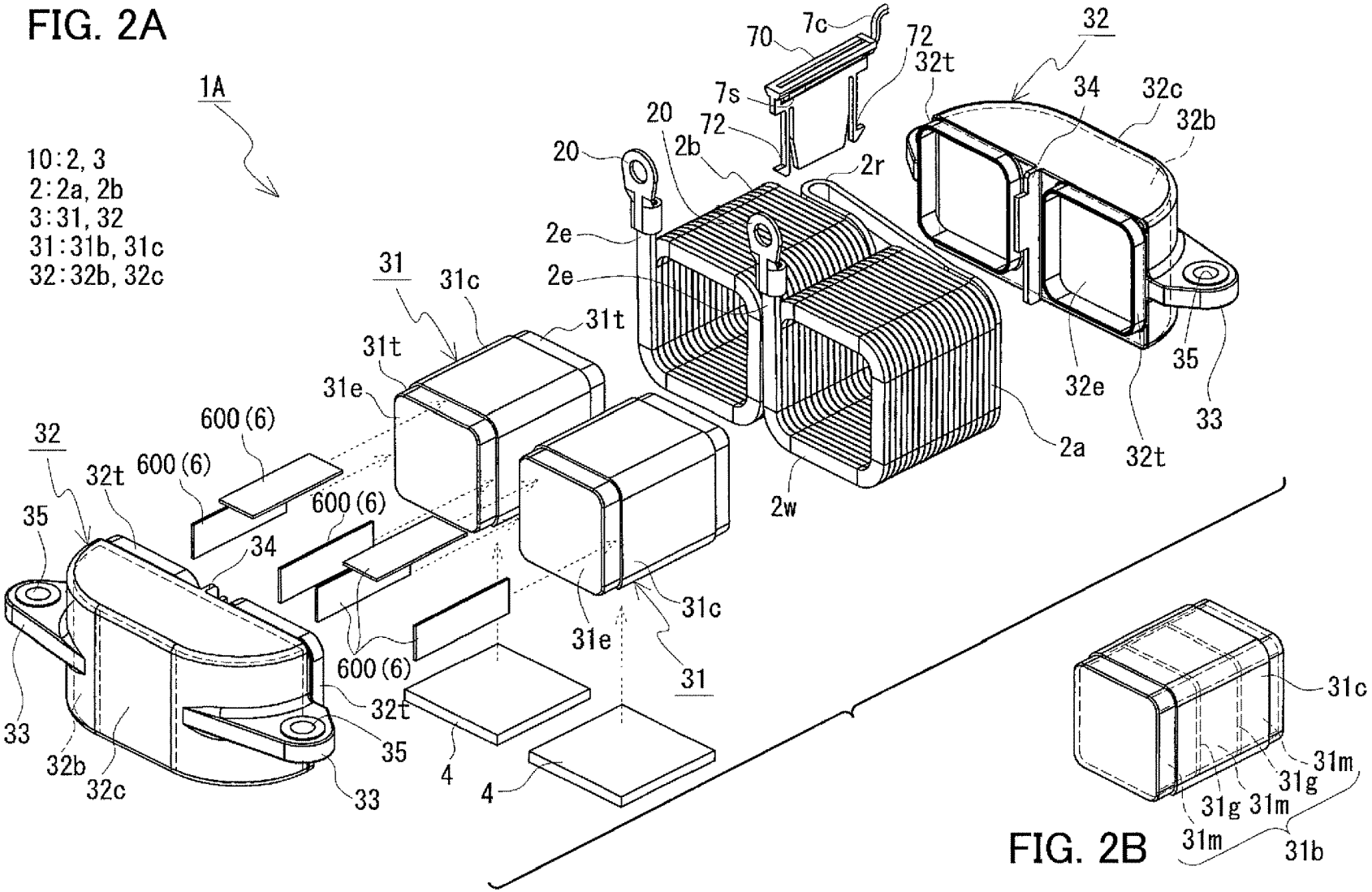
FIGS. 2A and 2B are exploded perspective views schematically illustrating the reactor according to Embodiment 1.

As shown in FIGS. 1 to 2B, the coil 2 includes a pair of wound sections 2*a* and 2*b* that are formed by spirally winding the coil wire 2*w*, and a connecting section 2*r* that connects both of the wound sections 2*a* and 2*b*. The wound sections 2*a* and 2*b* are formed in the shape of hollow tubes by winding the coil wire in the same direction with the same number of turns, and are arranged in parallel (side by side) such that their axial directions are in parallel to each other. In this example, each of the wound sections 2*a* and 2*b* is formed in the shape of a square tube, and has end surfaces in its coil axial direction in the shape of a substantially rectangular ring having rounded corners. That is, the inner circumferential surface of each of the wound sections 2*a* and 2*b* is constituted by four planes, and four corners (curved surfaces) that connect adjacent planes to each other. The coil wire 2*w* is a coated rectangular wire in which a conductor made of a rectangular wire has, on its surface, an insulating coating. The coil 2 (wound sections 2*a* and 2*b*) is an edgewise coil obtained by edgewise winding the coated rectangular wire.

The coil wire 2*w* is a coated wire in which a conductor made of a conducting material such as copper, aluminum, or an alloy thereof has, on its surface, an insulating coating made of a non-conducting material such as a polyamide-imide resin. Representative conductors are round wires and rectangular wires. In case of an edgewise coil in which the coil wire 2*w* is a rectangular wire as shown in this example, the coil has a higher space factor than a case in which a round wire is used, and thus there is an advantage that downsizing of the coil 2 (assembly 10) is possible. In this example, the coil wire 2*w* is an enamel wire in which a conductor is made of copper, and an insulating coating is made of polyamide imide.

Coil wire ends 2*e* of the coil 2 are drawn from turn forming sections in an appropriate direction. Here, the coil wire ends 2*e* of the coil 2 are drawn upward from the turn forming sections (upper surface of the coil) in a direction orthogonal to the coil axial direction (see FIG. 1). Furthermore, the insulating coating is removed and the conductor is exposed at the terminal of each coil wire end 2*e* of the coil 2, and a terminal fitting 20 is mounted at the position at which the conductor is exposed, the terminal fitting 20 being for connecting to a busbar (not shown) connected to an external device (not shown) such as an electric power source.

Magnetic Core

As shown in FIGS. 2A and 2B, the magnetic core 3 includes a pair of columnar inner core sections 31 that are arranged on the inside of the coil 2 (wound sections 2*a* and 2*b*), and a pair of block-like outer core sections 32 that protrude from the coil 2 (wound sections 2*a* and 2*b*) and are connected to the inner core sections 31. The respective inner core sections 31 are located on the inside of the wound sections 2*a* and 2*b* arranged side by side, and serve as sections on which the coil 2 is arranged. The outer core sections 32 are located on the outside of the wound sections 2*a* and 2*b*, and serve as sections on which the coil 2 is substantially not arranged (that is, the sections exposed from the coil 2). By the outer core sections 32 being arranged so as to sandwich the side-by-side inner core sections 31 from two sides and end surfaces 31*e* of the inner core sections 31 being connected to inner end surfaces 32*e* of the outer core sections 32, the magnetic core 3 is made annular, and when the coil 2 is excited, a closed magnetic path is formed.

As shown in FIGS. 2A and 2B, each inner core section 31 includes a middle body section 31*b* that constitutes the magnetic path, and a middle resin molded section 31*c* that covers at least a part of the outer circumferential surface of the middle body section 31*b*. The middle body section 31*b* is a stacked member in which a plurality of core pieces 31*m* made mainly of a soft magnetic material, and gap members 31*g* made of a material having a lower relative magnetic permeability than that of the core pieces 31*m* are alternately stacked (layered) on each other. The middle resin molded section 31*c* has the functions to ensure insulation between the coil 2 (wound section 2*a*, 2*b*) and the middle body section 31*b*, and to protect the middle body section 31*b* from the outer environment. The inner core section 31 is quadrangular prism-shaped conforming to the shape of the wound sections 2*a* and 2*b*, and has the end surfaces in the shape of a substantially rectangle having rounded corners. That is, the outer circumferential surface of the inner core section 31 is constituted by four planes and four owners (curved surfaces) connecting adjacent planes to each other, conforming to the inner circumferential surfaces of the wound sections 2*a* and 2*b*. In this example, in the inner core section 31, an installation target-side surface that is, the lower surface), which is opposite to the installation target (the object to which the reactor is to be installed), of the outer circumferential surface of the middle body section 31*b* is exposed without being covered with the middle resin molded section 3*c*, but insulation and corrosion resistance are ensured by the heat dissipating sheet 4 which will be described later.

As shown in FIGS. 2A and 2B, each outer core section 32 includes a side body section 32*b* that is part of the magnetic path, and a side resin molded section 32*c* that covers at least a part of a surface of the side body section 32*b*. The side body section 32*b* is a columnar core piece made mainly of a soft magnetic material.

The upper surfaces of the inner core sections 31 and the upper surfaces of the outer core sections 32 are substantially co-planar. On the other hand, the lower surfaces of the outer core sections 32 protrude from the lower surfaces of the inner core sections 31, and are substantially co-planar with the lower surface of the coil 2 (wound sections 2*a* and 2*b*). In other words, the lower surface of the assembly 10 is constituted mainly by the lower surfaces of two outer core sections 32 and the lower surface of the coil 2.

Heat Dissipating Sheets

The heat dissipating sheets 4 are disposed partially between the inner circumferential surfaces of the coil 2 (wound sections 2*a* and 2*b*) and the outer circumferential surfaces of the inner core sections 31 that are opposite to the inner circumferential surfaces of the coil 2, each heat dissipating sheet 4 being in contact with the coil 2 and the corresponding inner core section 31 and having the function to transfer the heat generated in the inner core section 31 to the coil 2. In this example, each heat dissipating sheet 4 is arranged between the inner circumferential surface of the coil 2 and the outer circumferential surface of the inner core section 31 on the installation target-side surface that is, the lower surface), which is opposite to an installation target, of the outer circumferential surfaces (four planes) of the inner core section 31 as shown in FIGS. 2A to 4B. In other words, the heat dissipating sheet 4 is arranged on the surface of the inner core section 31 on which the middle body section 31*b* is exposed, and is in contact with the middle body section 31*b*. Furthermore, the heat dissipating sheet 4 has the same size (area) as the lower surface of the inner core section 31, and is arranged in contact with substantially the entire lower surface of the inner core section 31 (middle body section 31*b*).

Thermal Conductivity

The thermal conductivity of the heat dissipating sheets 4 is at least 1 W/m·K, preferably at least 2 W/m·K, and further preferably at least 3 W/m·K.

Constituent Material

The heat dissipating sheets 4 shown in this example are made of an elastic material obtained by adding a heat conductive filler to a rubber material. The rubber material may be natural rubber or synthetic rubber. Examples of the synthetic rubber include acrylic rubber, silicone rubber, fluoro-rubber, olefin rubber, nitrile rubber, diene rubber, ethylene rubber, and polyurethane rubber. Examples of the heat conductive filler include at least one type of ceramics filler that is selected from silicon nitride, alumina, aluminum nitride, boron nitride, and silicon carbide. The heat dissipating sheets 4 in may be commercially available sheets or publicly known sheets.

The heat dissipating sheets 4 are made of a rubber material (elastic material), and have elasticity and flexibility. Accordingly, each heat dissipating sheet 4 deforms between the inner circumferential surface of the coil 2 (wound section 2*a*, 2*b*) and the outer circumferential surface of the inner core section 31, and thereby enters steps and gaps between the turns of the coil 2 (wound section 2*a*, 2*b*), recesses and projections on the outer circumferential surface of the inner core section 31, and the like so as to get into intimate contact with both the coil 2 and the inner core section 31. Furthermore, even if the heat dissipating sheet is in direct contact with the coil 2 and the inner core section 31, the heat dissipating shoot 4 hardly damages the coil 2 and the inner core section 31 as long as it is made of a material having elasticity and flexibility. The rubber hardness of the rubber material is, for example, at least 30 and not greater than 70, and is preferably at least 40 and not greater than 60. In this context, "rubber hardness" refers to a value measured in compliance with JIS K 6253:2006 (durometer A type).

Since the heat dissipating sheets 4 get into contact with the coil 2, the constituent material of the heat dissipating sheets 4 may preferably be a material with superior electrical insulation and excellent in heat resistance against the maximum temperature reached by the coil 2 (that is at least 150° C., and preferably at least 180° C.), and more preferably a material with superior corrosion resistance against the outer environment. The heat dissipating sheets 4 made of the material with superior electrical insulation can ensure insulation between the coil 2 and the inner core sections 31 (middle body sections 31*b*) at the positions at which the heat dissipating sheets 4 are arranged, even if the middle resin molded section 31*c* is not provided or a thin middle resin molded section 31*c* is provided. In this example, the heat dissipating sheets 4 are made of an elastic material in which silicone rubber contains an alumina filler, and have the thermal conductivity of about 4.5 W/m·K.

In this example, each heat dissipating sheet 4 is arranged in the axial direction of the inner core section 31 (direction from one end surface to the other end surface thereof). The length of the heat dissipating sheet 4 (length in the axial direction of the inner core section 31), and the width of the heat dissipating sheet 4 (length in the circumferential direction of the inner core section 31) can be selected as suitable. The area of the heat dissipating sheet 4 that is in contact with the coil 2 and the inner core section 31 increases with an increase in the length of the heat dissipating sheet 4 or an increase in the width of the heat dissipating sheet. 4, and the heat of the inner core section 31 is easily transferred to the coil 2. Accordingly, in view of the heat dissipation of the inner core section 31, the length of the heat dissipating sheet 4 is preferably at least 50%, more preferably at least 75%, and further preferably at least 90% of the length in the axial direction of the inner core section 31. Furthermore, the width of the heat dissipating sheet 4 is preferably at least 50%, more preferably at least 75%, and further preferably at least 90% of the length in the circumferential direction (width direction) of the surface of the inner core section 31 on which the heat dissipating sheet 4 is arranged (in this example, the lower surface). In this example, the length of the heat dissipating sheet 4 is substantially the same as the length in the axial direction of the inner core section 31, and the width of the heat dissipating sheet 4 is substantially the same as the width of the lower surface of the inner core section 31 (see, in particular, FIGS. 3 and 4). That is, the heat dissipating sheet 4 has such a shape that it has substantially the same area as the area of the surface (lower surface) of the inner core section 31 on which the heat dissipating sheet 4 is arranged.

The heat dissipating sheet 4 is compressed and deformed in the state of being arranged between the coil 2 and the inner core section 31. The thickness of the heat dissipating sheet 4 is the same as a clearance between the coil 2 and the inner core section 31. The clearance between the coil 2 and the inner core section 31 is, for example, at least 0.5 mm and not greater than 3 mm, and is, in this example, approximately at least 0.5 mm and not greater than 1 mm. Since there is a difference due to variation in sizes of the coil 2 and the inner core sections 31, the clearance between the coil 2 and the inner core section 31 is preferably configured such that the difference can be compensated for by the compression and deformation of the heat dissipating sheet 4. In this example, the thickness of the heat dissipating sheet before arrangement (before compression and deformation) is about 1.5 mm, and can be compressed to about ½ to ⅓ of its thickness.

At least one of the front and rear surfaces of the heat dissipating sheet 4 may have an adhesive layer. By having the adhesive layer on one of the front and rear surfaces, the heat dissipating sheet 4 can be adhered and fixed to the inner circumferential surface of the coil 2 (wound section 2*a*, 2*b*) or the outer circumferential surface of the inner core section 31. By fixing the heat dissipating sheet 4 to the inner circumferential surface of the coil 2 or the outer circumferential surface of the inner core section 31, it is easy to reliably arrange the heat dissipating sheet 4 between the coil 2 and the inner core section 31. Particularly, if the adhesive layer is firmed on the surface that is to be in contact with the inner core section 31 (middle body section 31*b*), the heat dissipating sheet 4 can be adhered to the exposed surface of the middle body section 31*b*, so as to be able to cover the exposed surface of the middle body section 31*b*. By adhering the beat dissipating sheet 4 to and covering the exposed surface of the middle body section 31*b*, it is possible to prevent the exposed surface of the middle body section 31*b* from getting into direct contact with the outer environment, and to enhance the corrosion-resistance against the outer environment. In addition, if the adhesive layer is formed on both the front and rear surfaces, the heat dissipating sheet 4 can be adhered to the inner circumferential surface of the coil 2 and the outer circumferential surface of the inner core section 31, enhancing fixation of the coil 2 by the adhesive layers.

Coil Fixing Sections

As shown in FIGS. 1 to 4B, the reactor 1A has coil fixing sections 6 that are interposed between the coil 2 and the inner core sections 31 and restrict the movement of the coil 2. Specifically each coil fixing section 6 is interposed between the inner circumferential surface of the coil 2 (wound section 2*a*, 2*b*) and the outer circumferential surface of the inner core section 31 that is opposite to the inner circumferential surface of the coil 2, and is disposed on at least a part of that section of the outer circumferential surface of the inner core section 31 at which no heat dissipating sheet 4 is arranged. In this example, the coil fixing sections 6 are arranged on the upper, left-side, and right-side surfaces of the outer circumferential surface (four planes) of the inner core section 31, except for the lower surface.

The coil fixing sections 6 are made of a foamed resin, and are disposed in a volume-expanded state in which they contain air bubbles caused by the foaming. By the volume expansion of the foamed resin, the coil fixing sections 6 presses the inner circumferential surfaces of the coil 2 (wound sections 2*a* and 2*b*) in the radial direction, and restricts the movement of the coil 2 (wound sections 2*a* and 2*b*) with this pressing force. Furthermore, the coil fixing sections 6 shown in this example are in intimate contact with the coil 2 and the inner core sections 31 due to the adhesiveness of the resin itself. Each coil fixing section 6 includes, as shown in a dashed-line circle of FIG. 4B, an inwardly interposed portion 60 and a turn interposed portion 62.

Inwardly Interposed Portion

The inwardly interposed portions 60 are portions that are interposed between the inner circumferential surface of the coil 2 (wound section 2*a*, 2*b*) and the outer circumferential surface of the inner core section 31, and are interposed partially, in circumferential direction, in an inner circumferential space formed between the inner circumferential surface of the coil 2 and the outer circumferential surface of the inner core section 31. The volume of the resin is expanded in the inner circumferential space, which is a substantially closed space, by a later-described thermal treatment in the manufacturing process, and thereby the inwardly interposed portion 60 presses the coil 2 and restricts the movement of the coil 2. Furthermore, the inwardly interposed portion 60 gets into intimate contact with both the coil 2 and the inner core section 31 due to the adhesivity of the resin itself, which also restricts the movement of the coil 2.

Figure 3:
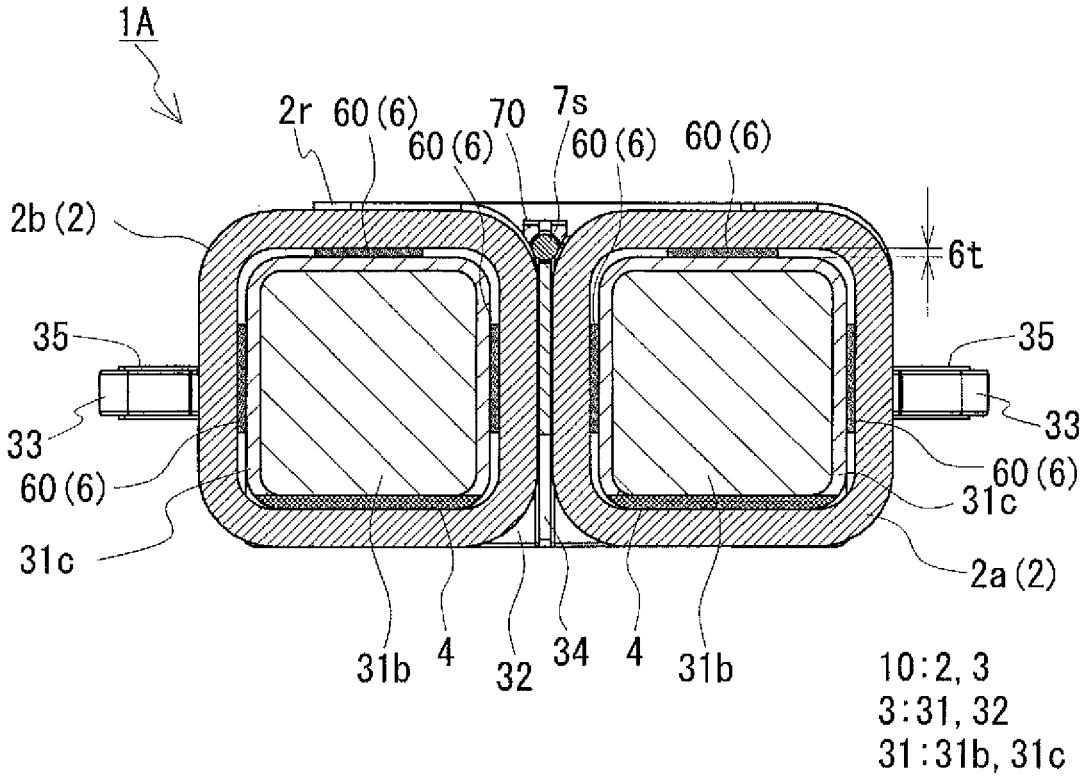
FIG. 3 is a horizontal cross-sectional view schematically illustrating the reactor according to Embodiment 1.

The coil fixing sections 6 (inwardly interposed portions 60) shown in this example are arranged along (parallel to) the axial direction of the inner core section 31 (direction from one end surface to the other end surface thereof). The length of the inwardly interposed portion 60 (length in the axial direction of the inner core section 31), and the width of the inwardly interposed portion 60 (length in the circumferential direction of the inner core section 31) may be selected as suitable. The area of the inwardly interposed portions 60 that is in contact with the coil 2 and the inner core section 31 increases with an increase in the length of the inwardly interposed portions 60 and an increase in the width of the inwardly interposed portion 60, restricting the movement of the coil 2. Accordingly in view of fixation of the coil 2, the length of the inwardly interposed portion 60 may preferably be at least 25%, more preferably at least 50%, at least 75%, and further preferably at least 90% of the length in the axial direction of the inner core section 31. Furthermore, the width of the inwardly interposed, portion 60 may preferably be at least 15%, at least 20%, more preferably at least 25%, at least 30%, at least 50%, and further preferably at least 75% of the length in the circumferential direction (width direction) of that surface (in this example, the upper or side surface) of the inner core section 31 on which the coil fixing section 6 is arranged. On the other hand, the inwardly interposed portions 60 may be shaped so as to have an area smaller than the area of the surface of the inner core section 31 on which the coil fixing sections 6 are arranged as long as they can actually fix the coil 2, and accordingly it is possible to reduce the amount of the material that is used for the coil fixing section 6. In this case, the width of the inwardly interposed portions 60 is preferably not greater than 95%, more preferably net greater than 90%, and further preferably not greater than 80% of the length in the circumferential direction of the surface of the inner core section 31. In this example, the length of each inwardly interposed portion 60 is substantially the same as the length in the axial direction of the inner core section 31, and the width of the inwardly interposed portion 60 is about 40% of the width of the upper surface or side surface of the inner core section 31 (see particularly FIGS. 3 to 4B). Furthermore, as shown in FIG. 3, each inwardly interposed portion 60 is located substantially at the center in the width direction of the upper or side surface of the inner core section 31, and a gap is present in a region of the inner circumferential space in which no inwardly interposed portion 60 is provided.

An average thickness 6*t* of the inwardly interposed portion 60 (see FIGS. 3 to 4B) depends on the distance (coil-core distance) between the inner circumferential surface of the coil 2 (wound section 2*a*, 2*b*) and the outer circumferential surface of the inner core section 31, and is substantially equal to this distance, and thus the shorter this distance is, the thinner the average thickness 6*t* can be. Here, the shorter the distance (hereinafter, referred to as "coil-core body distance") between the inner circumferential surface of the wound section 2*a* or 2*b* and the outer circumferential surface of the middle body section 31*b* is, the closer the coil 2 and the inner core section 31 are arranged to each other, achieving downsizing of the reactor 1A. Accordingly, in view of downsizing, the coil-core body distance is preferably not greater than 3 mm, more preferably not greater than 2.5 mm, particularly preferably not greater than 2 mm, not greater than 1.8 mm, and further preferably not greater than 1.5 mm. In this example, the average thickness 6*t* can be not greater than 2 mm, not greater than 1.8 mm, not greater than 1.5 mm, and further preferably not greater than 1 mm, in order to make it smaller than the coil-core body distance by the thickness of the middle resin molded section 31*c*. In this example, the coil-core body distance is not greater than 2.5 mm, the average thickness 6*t* is not greater than 1 mm, and the thickness of the middle resin molded section 31*c* is not greater than 2 mm.

Turn Interposed Portion

Figure 4A:
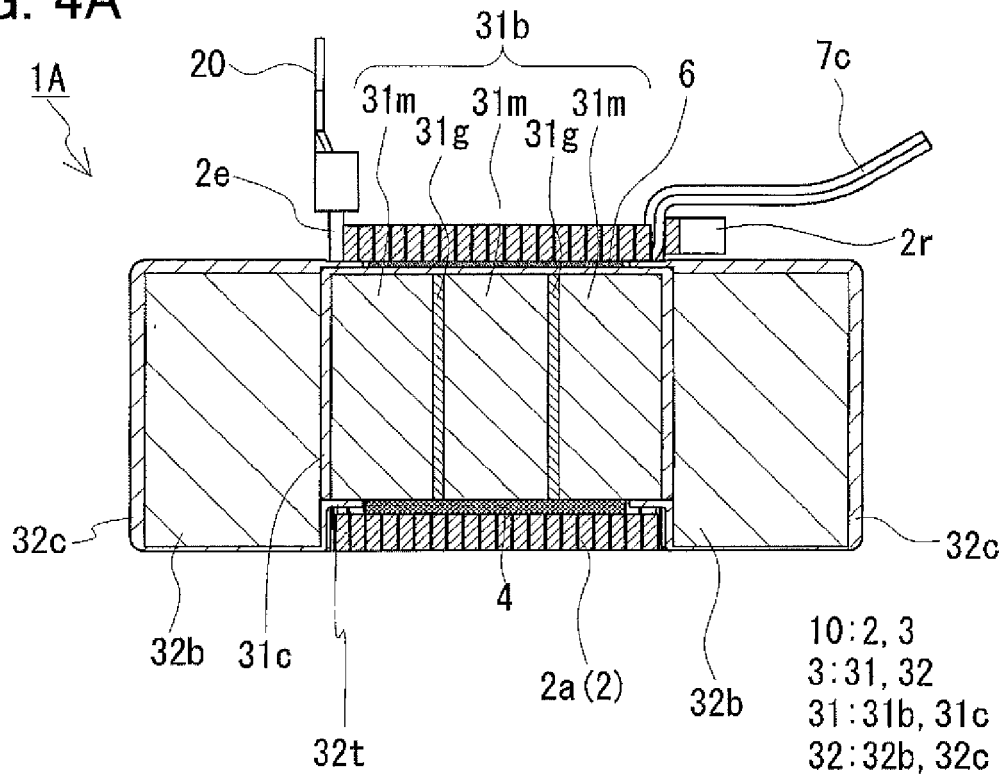
FIGS. 4A and 4B are vertical cross-sectional views schematically illustrating the reactor according to Embodiment 1.
Figure 4B:
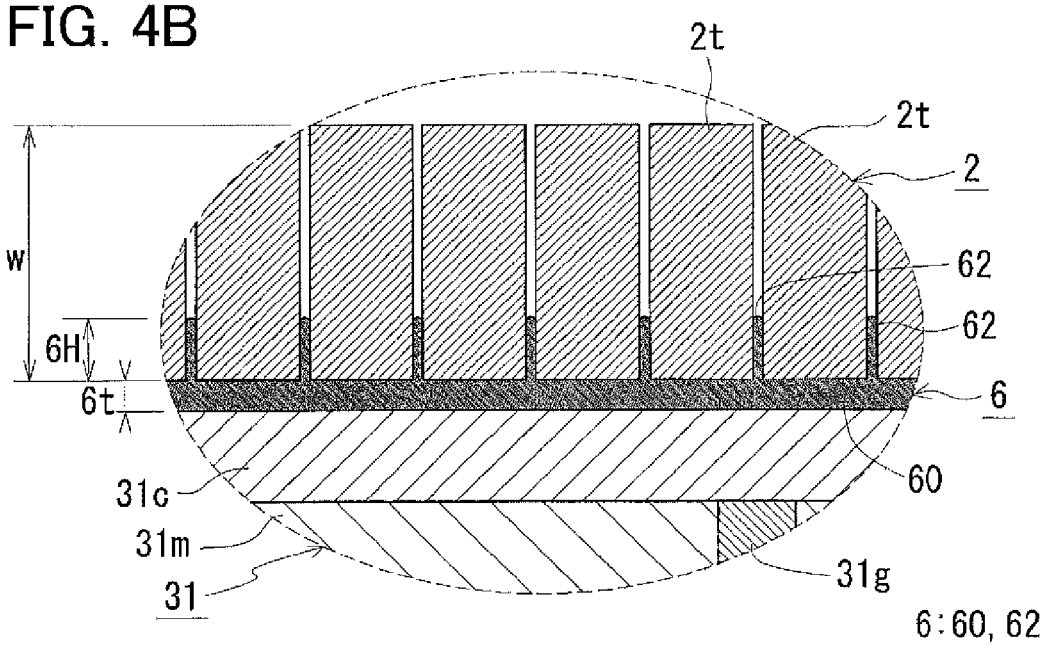

As shown in the dashed line circle of FIGS. 4A and 4B, the turn interposed portions 62 are portions that are interposed between at least one pair of adjacent turns 2*t* of the coil 2 (wound section 2*a*, 2*b*). In this example, the turn interposed portions 62 extend outward from the inner circumferential surfaces of the wound sections 2*a* and 2*b* to intermediate or midway locations of the turns 2*t*. That is, the turn interposed portions 62 are present only in the vicinity of the inner circumferential surfaces of the wound sections 2*a* and 2*b*, namely, in the regions that do not reach the outer circumferential surfaces of the wound sections 2*a* and 2*b*. Each turn interposed portion 62 is continuous to the above-described inwardly interposed portion 60, and is a portion that is formed by a part of the foamed resin constituting the inwardly interposed portion 60 entering the vicinity of the above-described inner circumferential surface between the adjacent turns 2*t*. The example of FIGS. 4A and 4B shows the case where the turn interposed portion 62 is present between all the adjacent turns 2*t*, but it is also possible that there are turns 2*t* between which no turn interposed portion 62 is provided.

Here, the turn section of the coil 2 (wound section 2*a*, 2*b*) is sandwiched between the pair of outer core sections 32, and the length in the axial direction of the turn section is restricted. In the later described manufacturing process, by the volume of the above-described foamed resin being expanded in such a restricting zone, the turn interposed portions 62 are being pressed into spaces between the adjacent turns 2*t* due to the volume expansion, restricting the movement of the coil 2 (particularly, the movement in the axial direction) with this pressing force.

As long as the presence of the inwardly interposed portions 60 can sufficiently restrict the movement of the coil 2, there is no limitation to the number of the turn interposed portions 62, their height 6H (distance in a direction from the inner circumferential surface toward the outer circumferential surface of the turns 2*t* of the coil 2 (wound section 2*a*, 2*b*)), and their thickness (substantially equal to the distance between adjacent turns 2*t*). As will be described later, this is because, if the turn interposed portions 62 are formed by a resin automatically entering between adjacent turns 2*t* when the resin foams, it will be difficult in practice to control the number of the turn interposed portions 60, their height 6H, and their thickness as designed. The larger the number of the turn interposed portions 62, their height 6H, or their thickness is, the easier the distance between the turns 2*t* can be widened by the turn interposed portion 62, making it easy to restrict the movement of the coil 2. The height 6H of the turn interposed portions 62 contributes to restriction of the movement of the coil 2 even if it is not greater than 50%, not greater than 25%, not greater than 20%, and furthermore not greater than 10% of the height of the turns 2*t* (here, the height of the turns 2*t* is equal to the width w of a coated rectangular wire that serves as the coil wire 2*w*).

Constituent Material

The coil fixing sections 6 are made of a plurality of air bubbles and a resin including the air bubbles, that is, a foamed resin. Since the coil fixing sections 6 get into contact with the coil 2, the resin constituting the coil fixing sections 6 is preferably a resin with superior electrical insulation, or a resin with superior heat resistance against the maximum temperature reached by the coil 2 (that is at least 150° C., and preferably at least 180° C.), and is further preferably a resin with superior corrosion resistance against the outer environment. Specific resins include an epoxy resin, a polyimide resin, a polyphenylene sulfide (PPS) resin, nylon, and the like.

Coil Fixing Section Forming Method

The coil fixing sections 6 are formed, for example, by cutting a non-foamed resin sheet into a predetermined shape, arranging the resin sheets 600 (see FIGS. 2A and 2B) at predetermined positions between the inner circumferential surfaces of the coil 2 (wound sections 2*a* and 2*b*) and the outer circumferential surfaces of the inner core sections 31, and then performing a thermal treatment necessary for foam formation. Since resin sheets are used, they have a uniform thickness, can easily be processed into a predetermined shape, have superior flexibility, and thus easily be arranged at a desired position, achieving excellent operability. Furthermore, since resin sheets, instead of a liquid resin, are used, the thickness or the shape of the coil fixing sections 6 (inwardly interposed portions 60) can be made uniform, and a problematic liquid leakage or the like is not caused, resulting in an improvement in the operability. The resin sheets 600 may be arranged, for example, by first arranging the inner core sections 31 in the coil 2, and then inserting the resin sheets 600 into the inner circumferential space between the coil 2 and the inner core sections 31. Alternatively, the resin sheets 600 may be arranged on, for example, adhered to the outer circumferential surfaces of the inner core sections 31, and then the inner core sections 31 are arranged in the coil 2.

The heating temperature and the hold time of the above-described thermal treatment may be selected as suitable according to the constituent material of the resin sheets 600. For example, the heating temperature may be at least 100° C. and not greater than 170° C. A resin (sheet) that needs only a low heating temperature and a short hold time is preferable because it can prevent, at the time of a thermal treatment, the heat damage of the coil 2, the magnetic core 3 (particularly, the resin molded sections 31*c* and 32*c*), and the heat dissipating sheets 4. Furthermore, the use of a resin (sheets) capable of forming foam at a low temperature and in a short time can improve manufacturability and also contributes to a reduction in cost.

The non-foamed resin sheets 600 may be commercially available sheets or publicly known sheets. For example, if a resin is used whose thickness after foam formation is at least three times, preferably at least 4.5 times, and more preferably at least 5 times of the resin thickness before foam formation (expansion rate (that is obtained by "thickness of a foamed resin/thickness of non-foamed resin") is at least 3, preferably at least 4.5, and more preferably at least 5), then the above-described pressing force is expected to sufficiently be exerted. A sheet that includes a non-foamed resin layer, and an adhesive layer on at least one of the front and rear surfaces can be used as a non-foamed resin sheet. If the resin sheets 600 include an adhesive layer on at least one of its front and rear surfaces, the resin sheets 600 can be adhered and temporarily fixed to the inner circumferential surfaces of the coil 2 (wound sections 2*a* and 2*b*) or the outer circumferential surfaces of the inner core sections 31. By fixing the resin sheets 600 to the inner circumferential surfaces of the coil 2 or the outer circumferential surfaces of the inner core sections 31, it is easy to reliably arrange the resin sheets 600 between the coil 2 and the inner core sections 31. In addition, if both the front and rear surfaces have adhesive layers, the coil fixing sections 6 (particularly, the inwardly interposed portions 60) can firmly be adhered to the inner circumferential surface of the coil 2 and the outer circumferential surface of the inner core section 31, enhancing not only fixation of the coil 2 in the pressed state but also firm fixation of the coil 2 by the adhesive layers. Furthermore, if an adhesive layer is provided, a plurality of resin sheets can be adhered to and stacked each other by the adhesive layer to form a coil fixing section 6 that has a desired thickness even if the non-foamed resin layer has a low thickness. The thickness of the non-foamed resin sheets 600 (also including, if an adhesive layer is provided, the thickness of the adhesive layer) may be selected so as to be at least the distance after the foam formation between the coil 2 and the inner core section 31, and may preferably be greater than this distance. For example, if the non-foamed resin sheets 600 have a thickness that is at least 0.2 mm, and an expansion rate that is 4, the average thickness 6*t* (thickness after the foam formation) of the inwardly interposed, portion 60 may be at least 0.8 mm. In this example, the resin sheets 600 are made of an epoxy resin containing a foaming agent, and have a thickness of about 0.2 mm and an expansion rate of about 4.

Reactor Manufacturing Method

The following will describe an example of a method for manufacturing the reactor 1A with reference mainly to FIGS. 2A and 2B.

First, the inner core sections 31 and the outer core sections 32 are prepared by producing them by insert molding or the like. Furthermore, the coil 2 is prepared by producing it by winding the coil wire 2*w* edgewise.

Then, the inner core sections 31 are inserted into the wound sections 2*a* and 2*b* of the coil 2, the coil 2 is arranged on the inner core sections 31, and the heat dissipating sheets 4 and the non-foamed resin sheets 600 are arranged at predetermined positions between the inner circumferential surfaces of the wound sections 2*a* and 2*b*, and the outer circumferential surfaces of the inner core sections 31. The heat dissipating sheets 4 can be arranged by first arranging the coil 2 on the inner core sections 31, and then inserting the heat dissipating sheets 4 into the gaps between the inner circumferential surfaces of the wound sections 2*a* and 2*b* and the outer circumferential surfaces of the inner core sections 31. Alternatively, the heat dissipating sheets 4 may be adhered to the lower surfaces of the inner core sections 31, and may be, together with the inner core sections 31, inserted into and arranged in the coil 2 when the coil 2 is arranged on the inner core sections 31. The heat dissipating sheets 4 are thinner than a clearance between the inner circumferential surfaces of the wound sections 2*a* and 2*b* and the outer circumferential surfaces of the inner core sections 31, and thus can be arranged easily. In this example, the thickness of the uncompressed and undeformed heat dissipating sheets 4 before arrangement is about 1.5 mm. The non-foamed resin sheets 600 are arranged by first arranging the coil 2 on the inner core sections 31, arranging the heat dissipating sheets 4 between the coil 2 and the inner core sections 31, and then inserting the resin sheets 600 into the inner circumferential spaces between the coil 2 and the inner core sections 31. Alternatively, similar to the heat dissipating sheets 4, the resin sheets 600 may be adhered to the upper and side surfaces of the inner core sections 31, and may be, together with the inner core sections 31, inserted into and arranged in the coil 2. The non-foamed resin sheets 600 are sufficiently thinner than the thickness of the inner circumferential spaces in the state in which the heat dissipating sheets 4 are arranged, and thus can be arranged easily. In this example, the thickness of the resin sheets 600 is about 0.2 mm. The heat dissipating sheets 4 and the resin sheets 600 are sheets that are cut into a predetermined shape and processed.

Then, by connecting the end surfaces 31*e* on one side of the inner core sections 31 to the inner end surfaces 32*e* of the outer core sections 32 on one side, and connecting the end surfaces 31*e* on the other side of the inner core sections 31 to the inner end surfaces 32*e* of the outer core sections 32 on the other side, the inner core sections 31 and the outer core sections 32 are coupled to each other, and the annular magnetic core 3 is formed. This way, it is possible to assemble the assembly 10 of the coil 2 and the magnetic core 3. The inner core sections 31 and the outer core sections 32 may be adhered to each other by an adhesive or the like.

Then, the assembly 10 in which the heat dissipating sheets 4 and the non-foamed resin sheets 600 are arranged between the coil 2 and the inner core sections 31 is subjected to a thermal treatment, and the resin sheets 600 are foamed. The resins obtained by foam formation of the resin sheets 600 fill up the inner circumferential spaces (here, over a part of the length in the circumferential direction and the entire length in the axial direction) between the coil 2 and the inner core sections 31, and get into intimate contact with the coil 2 and the inner core sections 31, so as to form the inwardly interposed portions 60 and the turn interposed portions 62. Accordingly, the reactor 1A that includes the heat dissipating sheets 4 and the coil fixing sections 6 can be obtained.

Functional Effects based on Main Characteristic Parts

According to the reactor 1A, of Embodiment 1, since the heat dissipating sheets 4 are interposed between the inner circumferential surfaces of the coil 2 and the outer circumferential surfaces of the inner core sections 31 so as to be in contact therewith, the heat of the inner core sections 31 is transferred to the coil 2 by the heat dissipating sheets 4, and is dissipated via the coil 2. Accordingly, it is possible to ensure heat dissipation paths from the inner core sections 31 to the coil 2, and improve the beat-dissipation performance of the inner core sections 31, resulting in the reactor 1A having excellent heat-dissipation performance. In particular, in the reactor 1A, since the heat dissipating sheets 4 are arranged on the installation target-side surfaces (lower surfaces) of the inner core sections 31, the heat dissipation paths from the inner core sections 31 to an installation target via the coil 2 are formed, making it possible to shorten the heat dissipation paths from the inner core sections 31 to the installation target. Therefore, it is easy to transfer the heat of the inner core sections 31 to the installation target via the coil 2, making it possible to efficiently dissipate the heat of the inner core sections 31 and improve the heat-dissipation performance. Furthermore, since each heat dissipating sheet 4 is arranged on the surface of the inner core section 31 on which the middle body section 31*b* is exposed, and is in contact with the middle body section 31*b*, the heat of the middle body section 31*b* can directly be transferred to the coil 2 by the heat dissipating sheets 4. Accordingly, due to absence of the middle resin molded section 31*c*, the thermal resistance of the heat dissipation paths can be reduced, and thus it is possible to efficiently dissipate the heat of the inner core sections 31 and to improve the heat-dissipation performance.

The reactor 1A of Embodiment 1 includes the coil fixing sections 6 between the coil 2 and the inner core sections 31, and the movement of the coil 2 is restricted by the pressing force caused by volume expansion of foamed resins constituting the coil fixing sections 6, and thereby the coil 2 is fixed to the magnetic core 3 (inner core sections 31). Accordingly, it is possible to restrict the movement of the coil 2 with respect to the inner core sections 31 in the axial direction, the radial direction, and the circumferential direction, due to vibration of the coil 2 and the magnetic core 3 at the time of operation of the reactor, vibration when the vehicle is driving, influence of the outer environment, or the like. Since the movement of the coil 2 is restricted, the coil 2 can be suppressed from colliding or rubbing against the magnetic core 3 (inner core sections 31 and the outer core sections 32), and adjacent turns 2*t* of the coil 2 can be suppressed from colliding or rubbing against each other. Accordingly, it is possible to reduce noise resulting from the collision or rubbing, damage of the insulating coating of the coil 2, damage of the magnetic core 3, and the like. Since the movement of the coil 2 is restricted, the locations where the coil wire end 2*e* are connected to busbars are not likely to be subjected to stress, making it possible to suppress the deformation and damage of the connected part. Particularly, in the reactor 1A of Embodiment 1, since non-foamed resin sheets 600 are used for the coil fixing sections 6, the thickness and the shape of the coil fixing sections 6 can be made uniform, and the coil fixing sections 6 also have excellent manufacturability since the resin sheets 600 need only to be arranged on necessary portions. In contrast, if a liquid resin were used for the coil fixing sections 6, there would be many problems in workability, such that, for example the shape does not become stable, it is also difficult to apply the resin with a uniform thickness, an applying step takes time, and a liquid leakage occurs.

In the reactor 1A of Embodiment 1, the coil 2 is fixed to the magnetic core 3 (inner core sections 31) by the coil fixing sections 6, and thus in contrast to the conventional case, it is not necessary to cover the assembly 10 with a sealing material or a resin mold and to fix the coil 2 to the magnetic core 3, and no sealing material or the like is included. Accordingly, it is possible to omit the sealing material, the resin mold, and a case to be filled with the sealing material, achieving downsizing, lightweighting, and a reduction in cost. Furthermore, the step for forming the sealing material or the resin mold can be omitted.

Description of Configurations Including Other Characteristic Parts

The following will describe the details of configurations of the reactor 1A, and other available configurations.

Coil

As shown in FIGS. 1 to 2B, the coil 2 is made of one continuous coil wire 2*w*. Specifically, the coil 2 is thrilled by forming one wound section 2*a* from a proximal end to a distal end, then bending the coil wire 2*w* drawn out from the other end side in a U-shape to form the connecting section 2*r*, and subsequently thrilling the other wound section 2*b* from the distal end to the proximal end. Alternatively, the coil 2 may be formed by forming the wound sections 2*a* and 2*b* with separate coil wires, and bonding together the coil wire ends on the other end side of the wound sections 2*a* and 2*b* directly by welding, soldering, crimping, or the like, or via a connecting member (for example, plate member) made of a separately prepared conducting material. Furthermore, in this example, the end surfaces in the axial direction of the wound sections 2*a* and 2*b* have the shape of a substantially rectangular ring, but the shape may suitably be changed to, for example, a substantially circular ring, or the like.

Magnetic Core

Inner Core Section

As shown in FIGS. 2A and 2B, each inner core section 31 includes a middle body section 31*b* in which the core pieces 31*m* and the gap members 31*g* are alternately stacked, and a middle resin molded section 31*c* that covers the outer circumferential surface of the middle body section 31*b*. In this example, the core pieces 31*m* and the gap members 31*g* are adhered to each other by an adhesive. The shape of the middle body section 31*b* may be selected as suitable. In this example, the middle body section 31*b* is quadrangular-prism shaped.

A soft magnetic material of nonmetal such as iron, an iron alloy, or ferrite may be used for the material of the core pieces 31*m*. Each of the core pieces 31*m* may be a molded (or compacted) body made using soft magnetic powder of a soft magnetic material, or a stacked body in which a plurality of magnetic thin plates (for example, electromagnetic steel sheets represented by silicon steel plates) including an insulation coating, are stacked. Examples of the molded body include, in addition to a powder compacted molded body (powder compacted magnetic core), a sintered body, and a composite material including soft magnetic powder and a resin. The composite material can easily be molded even into a complicated three-dimensional shape by injection molding or the like. The resin serving as a binder of the composite material may be a thermosetting resin such as an epoxy resin, or a thermoplastic resin such as a polyphenylene sulfide (PPS) resin. The amount of the soft magnetic powder contained in the composite material may be, for example, at least 20 vol % and not greater than 75 vol %, assuming that the amount of the composite material is 100 vol %. The remainder is a nonmetallic organic material of, for example, a resin or a ceramic such as alumina or silica, or a nonmagnetic material such as a nonmetallic inorganic material. Here, each core piece 31*m* is a powder compacted molded body.

Ordinarily, a core piece made of a powder compacted molded body or a composite material has low thermal conductivity, and if the inner core section 31 is configured by core pieces made of powder compacted molded bodies or a composite material, it is difficult for the heat of the inner core section 31 to be transferred to the outer core section 32 and be dissipated. In particular, core pieces made of a composite material have lower thermal conductivity and larger thermal resistance than core pieces made of powder compacted molded bodies. As described above, by the reactor 1A of Embodiment 1 including the heat dissipating sheets 4, it is possible to transfer the heat of the inner core sections 31 to the coil 2 using the heat dissipating sheets 4, and to improve the heat-dissipation performance of the inner core sections 31. Accordingly, the reactor 1A of Embodiment 1 is appropriate for the case that the core pieces 31*m* constituting the inner core sections 31 are made of powder compacted molded bodies or a composite material.

The material of which the gap members 31*g* are made may be a nonmagnetic material such as alumina or unsaturated polyester, a mixture of a nonmagnetic material such as a PPS resin and a soft magnetic material (for example, soft magnetic powder such as iron powder), or the like.

A region covered with the middle resin molded section 31*c* may be at least a region on the outer circumferential surface of the middle body section 31*b* on which the coil 2 is arranged. Furthermore, if the entire outer circumferential surface of the middle body section 31*b* is covered with the middle resin molded section 31*c*, it will be possible to improve the corrosion resistance against the outer environment. The region covered with the middle resin molded section 31*c* may include or may not include the end surfaces 31*e* of the inner core section 31 (end surface of the middle body section 31*b*) that are to be connected to the inner end surfaces 32*e* of the outer core sections 32. Since the end surfaces 31*e* of the inner core section 31 are connected to the inner end surfaces 32*e* of the outer core sections 32, the end surfaces 31*e* are not exposed and do not get into contact with the outer environment in the state in which the magnetic core 3 is assembled. Ordinarily, the material of which the middle resin molded section 31*c* is made is nonmagnetic, and the middle resin molded section 31*c* functions as a gap member if it covers the end surfaces 31*e*. In this example, the region covered with the middle resin molded section 31*c* covers all outer circumferential surface of the middle body section 31*b* except for the lower surface (that is, the upper and right and left side surfaces), as well as both end surfaces. The material of which the middle resin molded section 31*c* is made will be described later.

In the reactor 1A of the Embodiment 1, since the heat dissipating sheets 4 are arranged on the exposed surfaces of the middle body sections 31*b*, the corrosion resistance is ensured by the heat dissipating sheets 4. The entire outer circumferential surface of each middle body section 31*b* may be covered with the middle resin molded section 31*c* in view of enhancement of the corrosion resistance. In this case, in the section on which the heat dissipating sheet 4 is arranged, the corrosion resistance can be ensured to some extent by the heat dissipating sheet 4, and thus the section of the middle resin molded section 31*c* on which the heat dissipating sheet 4 is arranged may have the thickness smaller than that of other sections. Alternatively, it is also possible to enhance the corrosion resistance by applying a rust inhibitor to the exposed surface of the middle body section 31*b*.

Outer Core Section

As shown in FIGS. 2A and 2B, each outer core section 32 includes a side body section 32*b* made of a core piece, and a side resin molded section 32*c* that covers the surface of the side body section 32*b* entirely except for a part thereof. The shape of the side body section 32*b* may be selected as suitable. In this example, the side body section 32*b* is a column-shaped section whose upper and lower surfaces are dome-shaped (modified trapezoidal shape whose cross-sectional area becomes smaller toward the outside from the inner end surface 32*e* to which the end surfaces 31*e* of the inner core sections 31 are connected). The material of which the side body section 32*b* is made may be the same as the material of the above-described core pieces 31*m*, and the side body section 32*b* may be a molded body of soft magnetic powder, or a stacked body in which a plurality of magnetic thin plates are stacked. Here, both side body sections 32*b* are powder compacted molded bodies.

Figure 5:
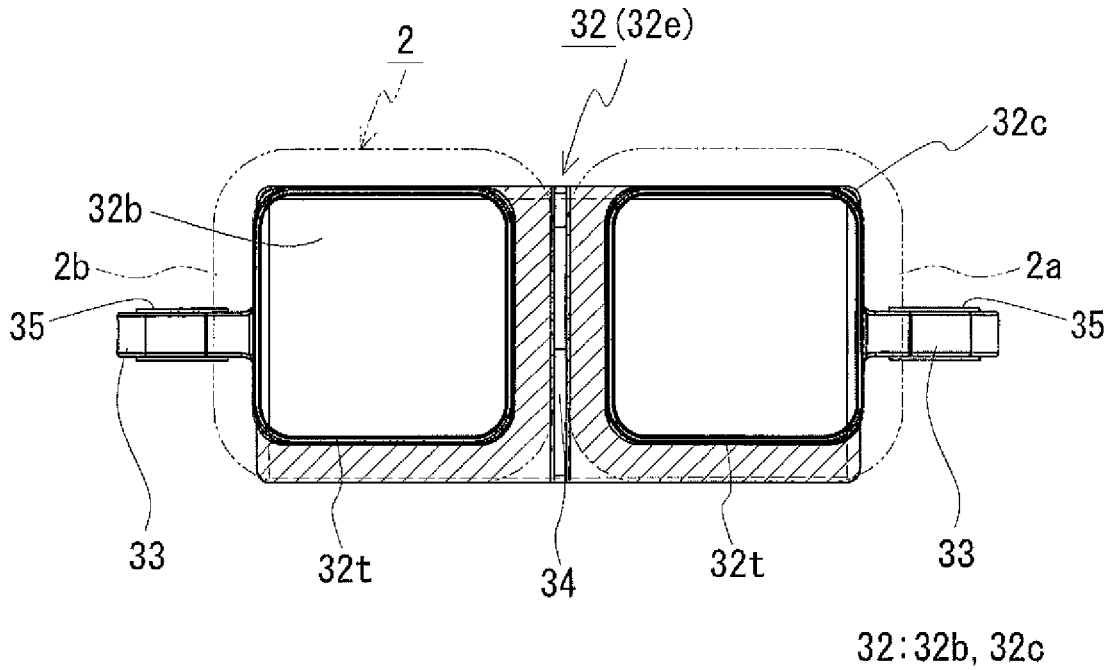
FIG. 5 is a diagram schematically illustrating coil-opposing regions of an inner end surface of an outer core section of the reactor according to Embodiment 1.

The inner end surface 32*e* of the outer core section 32 is a surface that includes core connection regions to which the end surfaces 31*e* of the inner core sections 31 are connected, and coil-opposing regions that are opposite to the end surface of the coil 2 (wound sections 2*a* and 2*b*), the core connection regions and the coil-opposing regions being formed planarly. In this example, as shown in FIG. 5, the coil-opposing regions of the inner end surface 32*e* of the outer core section 32 are two L-shaped regions (indicated by hatching in the drawing) that are opposite to L-shaped sections that are respectively formed by adjacent sides of the end surfaces of the wound sections 2*a* and 2*b*, the lower sides thereof, and the corners that connect these sides to each other.

The side resin molded section 32*c* has the function to protect the side body section 32*b* from the outer environment. The region covered with the side resin molded section 32*c* may be a region that is at least exposed in the state in which the magnetic core 3 is assembled. Accordingly, it is possible to prevent the side body section 32*b* from getting into direct contact with the outer environment, and to impart the side body section 32*b* with corrosion resistance against the outer environment. Furthermore, if the coil-opposing regions of the inner end surface 32*e* of the outer core section 32 that are opposite to the end surface of the coil 2 (wound sections 2*a* and 2*b*) are covered with the side resin molded section 32*c*, insulation between the coil 2 and the side body section 32*b* can also be ensured. The material of which the side resin molded section 32*c* is made will be described later.

The region covered with the side resin molded section 32*c* may include or may not include the above-described core connection regions of the inner end surface 32*e* of the outer core section 32 (inner end surface of the side body section 32*b*) to which the end surfaces 31*e* of the inner core sections 31 are to be connected. Since the end surfaces 31*e* of the inner core sections 31 are to be connected to the core connection regions of the inner end surface 32*e* of the outer core section 32, the core connection regions will not be exposed and get into contact with the outer environment in the state in which the magnetic core 3 is assembled. Ordinarily, since the material of which the side resin molded sections 32*c* are made is nonmagnetic, the core connection regions, if covered, will function as the gap members. If either one of the end surface 31*e* of the inner core section 31 (end surface of the middle body sections 31*b*) and the core connection region of the inner end surface 32*e* of the outer core section 32 (inner end surface of the side body section 32*b*) to which the inner core section 31 is connected is covered with the middle resin molded section 31*c* or the side resin molded section 32*c*, it is preferable that the other one be exposed. In this example, the inner end surface of the side body section 32*b* is covered with the side resin molded section 32*c* entirely, except for the core connection regions.

The material of which the middle resin molded section 31*c* and the side resin molded section 32*c* that may be referred to collectively as "resin molded section") are made is preferably a resin material that is insulating and has corrosion resistance, and more preferably a resin material having thermal conductivity. Examples of such a resin material include a thermoplastic resin such as a PPS resin, e polytetrafluoroethylene (PTFE) resin, liquid crystal polymer (LCP), nylon 6, nylon 66, and a polybutylene terephthalate (PBT) resin. The resin material constituting the resin molded sections 31*c* and 32*c* may contain at least one type of ceramic filler selected from silicon nitride, alumina, aluminum nitride, boron nitride, and silicon carbide, in view of enhancement of heat-dissipation performance. The formation of the resin molded sections 31*c* and 32*c* may be performed, for example, by insert molding of a resin material, or dipping the sections into a resin material.

The thickness of the resin molded sections 31*c* and 32*c* may be, for example, at least 0.1 mm. By setting the thickness of the resin molded sections 31*c* and 32*c* to be at least 0.1 mm, it is easy to ensure insulation against the coil 2 (wound sections 2*a* and 2*b*), and to impart corrosion resistance against the outer environment. On the other hand, the upper limit of the thickness of the resin molded sections 31*c* and 32*e* may suitably be set as long as it is not too thick, and may be, for example, not greater than 3 mm. The resin molded sections 31*c* and 32*c* may include a locally thickened portion (such as, for example, a mounting section 33 or a partition section 34 of the side resin molded section 31*c*).

In this example, the core pieces 31*m* of the middle body sections 31*b* and the side body sections 32*b* (core pieces) are made of powder compacted molded bodies, but the core pieces 31*m* and the side body sections 32*b* may be made of the above-described composite material. In this case, a configuration is also possible in which the middle body sections 31*b* and the side body sections 32*b* are not covered with the resin molded sections 31*c* and 32*c*. That is, the inner core sections 31 and the outer core sections 32 are respectively configured by the middle body sections 31*b* and the side body sections 32*b* that are made of a composite material, and do not include resin molded sections. II the core pieces are made of a composite material, the surface region thereof will hardly include soft magnetic powder, and will include a resin layer made of a resin contained in the composite material. Accordingly, if no resin molded section is provided, it is easy to ensure insulation against the coil 2, and to suppress corrosion of the soft magnetic powder contained in the composite material. Of course, the middle body sections 31*b* and the side body sections 32*b* may be covered with the resin molded sections 31*c* and 32*c*, but in this case, the material of which the resin molded section is made may be a resin material that does not soften or damage the resin of the composite material when the resin molded section is formed.

The magnetic core 3 is formed by the inner core sections 31 and the outer core sections 32 being connected to each other. In this example, the inner core sections 31 and the outer core sections 32 are adhered to each other by an adhesive. Furthermore, in this example, each side resin molded section 32*c* includes projecting wall sections 32*t* that enclose the peripheries of the core connection regions on the inner end surface 32*e* of the outer core section 32. The ends of the inner core sections 31 are fitted into the projecting wall sections 32*t*, and the end surfaces 31*e* of the inner core sections 31 are configured to be connected to the core connection regions of the inner end surfaces 32*e* of the outer core sections 32. Furthermore, each outer circumferential surface of the end of the inner core section 31 that is to be fitted into the projecting wall section 32*t* has a thinned section 31*t* having a lower thickness than that of the middle resin molded section 31*c*, and the outer circumferential surface of the projecting wall section 32*t* and the outer circumferential surface of the inner core section 31 except for the end thereof are substantially co-planar.

Figures 6A, 6B:
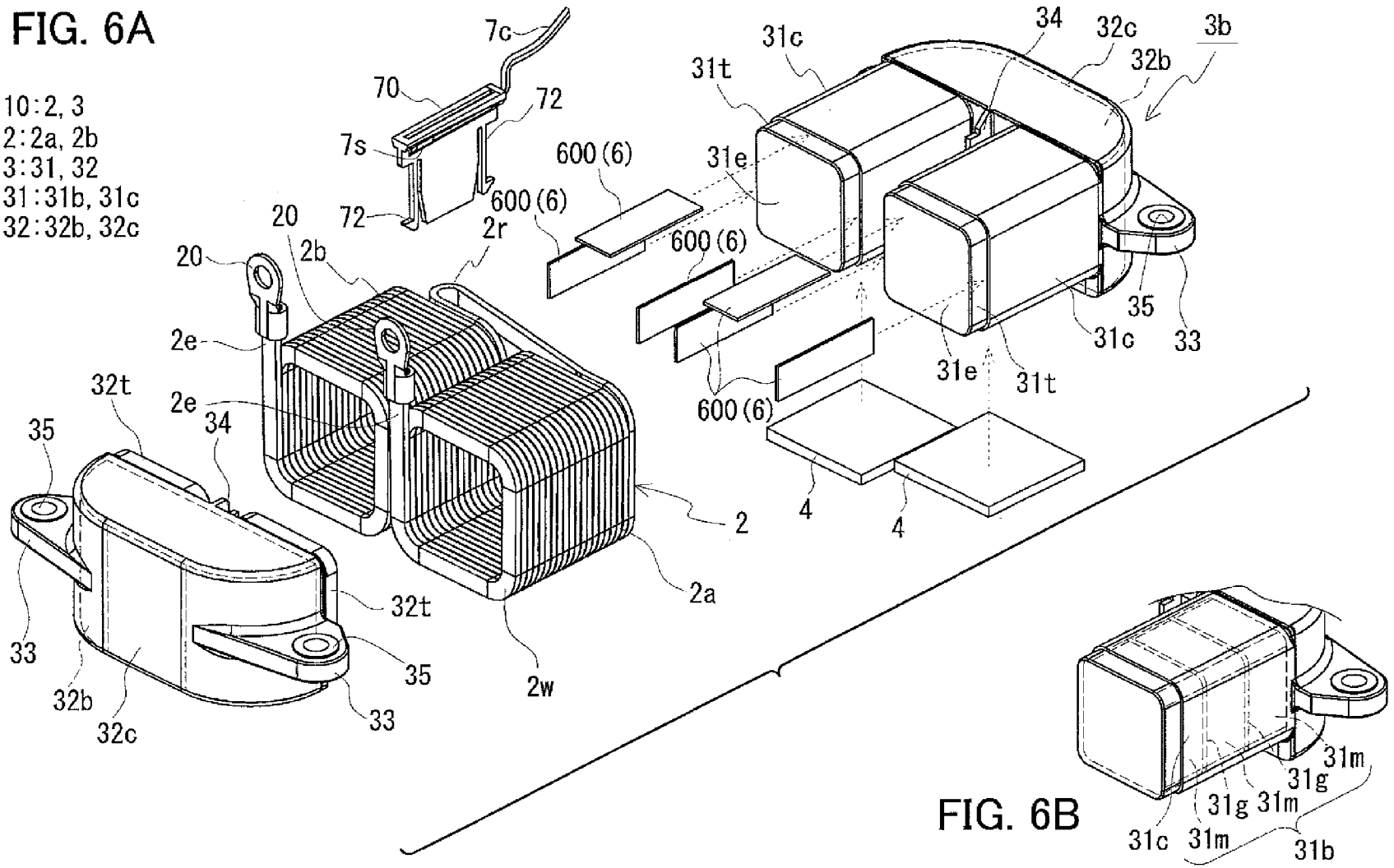
FIGS. 6A and 6B are diagrams schematically illustrating a modification of a magnetic core of the reactor according to Embodiment 1.

This example has described a configuration in which the pair of inner core sections 31 and the pair of outer core sections 32 are independent (separate) from each other. Alternatively, a configuration is also possible in which at least one of the inner core sections 31 and one of the outer core sections 32 are formed as a single piece. For example, as shown in FIGS. 6A and 6B, two inner core sections 31 and one outer core section 32 may be formed as an integrated U-shaped core molded body 3*b*. In this case, it is preferable to form the middle resin molded sections 31*c* and the side resin molded section 32*c* as a single piece, by covering the middle body sections 31*b* of the two inner core section 31 and the side body section 32*b* of the one outer core section 32 with a resin material in the state in which they are connected to each other. Accordingly, it is possible to achieve the U-shaped core molded body 3*b* in which the two middle body sections 31*b* and the side body section 32*b* are integrated, that is, the two inner core sections 31 and the one outer core section 32 are integrated. The middle body sections 31*b* and the side body section 32*b* may be adhered to each other in advance by an adhesive, or may not be adhered to each other by an adhesive since they are integrated by forming the middle resin molded sections 31*c* and the side resin molded section 32*c* as a single piece. Also, by adhering this U-shaped core molded body 3*b* and the remaining outer core section 32 to each other by, for example, an adhesive, it is possible to form the magnetic core 3. Alternatively, a configuration is also possible in which a pair of L-shaped core molded bodies in which one inner core section 31 and one outer core section 32 are formed as a single piece are provided. In this case, it is preferable to form the middle resin molded section 31*c* and the side resin molded section 32*c* as a single piece, by covering the middle body section 31*b* of the inner core section 31 and the side body section 32*b* of the outer core section 32 that are connected to each other with a resin material. The middle body section 31*b* and the side body section 32*b* are thus integrated, and the L-shaped core molded body in which the inner core section 31 and the outer core section 32 is integrated can be obtained. By adhering the pair of L-shaped core molded bodies by, for example, an adhesive, the magnetic core 3 can be formed.

The adhesive may suitably be an adhesive mainly made of a resin such as (1) a thermosetting resin such as an epoxy resin, a silicone resin, or unsaturated polyester, (2) a thermoplastic resin such as a PPS resin or LCP, or the like.

Heat Dissipating Sheet

The heat dissipating sheets 4 may be made of a composite material in which a heat conductive filler made of an inorganic material such as a ceramic is added to an organic material such as rubber, gel, or a resin. In the reactor 1A of Embodiment 1, the heat dissipating sheets 4 are rubber type heat dissipating sheets whose constituent material is a rubber material. In addition to rubber-type sheets, various types of heat dissipating sheets such as gel-type or thermal fusion bonded-type sheets may be used as the heat dissipating sheets 4. The gel-type or thermal fusion bonded-type heat dissipating sheets may be commercially available sheets or publicly known sheets.

A gel-type heat dissipating sheet is a sheet made of a gel material, and examples of the gel material include silicone gel, acrylic gel, and urethane gel. A gel-type heat dissipating sheet has, similar to a rubber-type sheet, elasticity and flexibility, and thus by being sandwiched and deformed between the inner circumferential surface of the coil 2 and the outer circumferential surface of the inner core section 31, enters steps and gaps between turns of the coil 2, and recesses and projections of the outer circumferential surface of the inner core section 31, and the like, making it possible to get into intimate contact with both the coil 2 and the inner core section 31. In addition, the gel material is viscous, and thus has high adhesiveness. The hardness of the gel material may be a value measured by an asker C type durometer that is in compliance with JIS K 7312:1196, for example, at least 30.

A thermal fusion bonding heat dissipating sheet is a sheet made of a thermal fusion bonding material, which is fused or softened by heat, displays a fusing bonding property, and then is hardened. Examples of thermal fusion bonding materials include an epoxy resin and a polyimide resin. In the case of the thermal fusion bonding heat dissipating sheet, by being disposed between the coil 2 and the inner core section 31 in a state in which it is not yet hardened, and then being heated, the heat dissipating sheet is fused and bonded to the coil 2 and the inner core section 31. At that time, the heat dissipating sheet is deformed, enters steps or gaps between the turns of the coil 2, recesses and projections on the outer circumferential surface of the inner core section 31, or the like, and gets into intimate contact with the inner circumferential surface of the coil 2 or the outer circumferential surface of the inner core section 31. By being hardened in this state, a heat dissipating sheet that is in intimate contact with the coil 2 and the inner core section 31 can be obtained, and can exert high heat dissipation.

When a thermal fusion bonding heat dissipating sheet is used, the thermal fusion bonding heat dissipating sheet is disposed at a predetermined position between the inner circumferential surface of the coil 2 (wound section 2*a*, 2*b*) and the outer circumferential surface of the inner core section 31, and then is subjected to a thermal treatment necessary for being fused and hardened. The heating temperature and the hold time of the thermal treatment may be selected as suitable according to the constituent material of the heat dissipating sheet, and the heating temperature may be at least 80° C. and not greater than 160° C., for example.

Other Considerations

Mounting Section

The resin molded sections 32*c* of both outer core sections 32 have mounting sections 33 for attaching the assembly 10 to an installation target, the mounting sections 33 being formed as a single piece with the resin molded sections 32*c* (see FIGS. 2A and 2B). In this example, each outer core section 32 has two mounting sections 33, that is, four mounting sections 33 in total are provided. Each mounting section 33 is formed protruding from a substantially center position in the vertical direction (height direction) of the outer core section 32. The position at which the mounting section 83 is formed corresponds to a fixation position (for example, bolt boss part) of the installation target. The mounting section 33 has a buried tubular collar 35 that has a through-hole through which a fixing member for example, a bolt) for fixing the assembly 10 to the installation target can be inserted. The collar 35 is preferably made of a highly rigid material, for example, a metal material such as stainless steel, in view of prevention of deformation of the through-hole.

Partition Section

The resin molded sections 32*c* of both outer core sections 32 each have a partition section 34 that is provided, between the wound sections 2*a* and 2*b*, the partition section 34 being formed as a single piece with the resin molded sections 32*c* (see FIGS. 2A and 2B). The partition sections 34 can prevent the wound sections 2*a* and 2*b* from getting into contact with each other, enhancing the insulation between the wound sections 2*a* and 2*b*.

Sensor

As shown in FIGS. 2A and 2B, the reactor 1A may include a sensor 7*s* for measuring a physical amount (for example, temperature, current value, electric voltage value, acceleration, or the like) at the time of operation of the reactor. The sensor 7*s* shown in FIGS. 2A and 2B is a temperature sensor that includes a heat sensitive element such as a thermistor, and includes a protection section (for example, tube made of a resin or the like) for protecting the heat sensitive element, and a wiring 7*c* through which an electric signal from the heat sensitive element flows. Furthermore, the sensor 7*s* is arranged between the wound sections 2*a* and 2*b*, and is accommodated in a holder 70.

The holder 70 has the function to hold the sensor 7*s* at a predetermined arrangement position with respect to the assembly 10. As shown in FIGS. 2A and 2B, the holder 70 is inserted between the wound sections 2*a* and 2*b*, includes hooks 72 for latching with the partition sections 34 of the outer core sections 32, and can appropriately maintain the arrangement position of the sensor 7*s* by the hooks 72 latching to the partition sections 34. The holder 70 may preferably be made of an insulating resin, like the above-described resin molded sections 31*c* and 32*c*.

Example of Use of Reactor

As an example of use of the reactor 1A, it is conceivable that the assembly 10 in the original state without being covered with a sealing material or the like (that is, in the state in which the outer circumferential surface of the coil 2 is exposed) is attached to an installation target (not shown) such as a cooling base or a converter case before use. Specifically, the lower surface of the reactor 1A is placed on the installation target such as a cooling base, and the reactor 1A is fixed to the installation target by bolts or the like. When the reactor 1A (assembly 10) is placed on the installation target, an adhesion layer (not shown) or the above-described heat dissipating sheet (not shown) may be formed on the installation target-side surface (installation surface) of the assembly 10 (particularly, the coil 2) that is opposite to the installation target. By the adhesion layer or the heat dissipating sheet being provided on the installation surface (that is, the lower surface) of the assembly 10 (particularly, the coil 2), it is easy to ensure insulation between the coil 2 and the installation target. Furthermore, providing the adhesion layer makes it possible to firmly fix the assembly 10 (particularly, the coil 2) to the installation target, together with fixation by bolts. Providing the heat dissipating sheet makes it possible to improve the heat-dissipation performance of the assembly 10 (particularly, the coil 2).

A representative material of the adhesion layer is preferably a resin material (adhesive) having heat resistance to the extent that it is not softened at the maximum temperature in use of the reactor, and more preferably a resin material that is insulating. Specifically, the adhesion layer may be made of a thermosetting resin such as an epoxy resin, a silicone resin, or an unsaturated polyester, or a thermoplastic resin such as a PPS resin, or a LCP. The resin material of which the adhesion layer is made may contain the above-described ceramics filler in view of enhancement of the heat-dissipation performance. The adhesion layer whose thermal conductivity is preferably at least 0.1 W/m·K, more preferably at least 1 W/m·K, and particularly preferably at least 2 W/m·K is preferable since it has excellent thermal conductivity. The adhesion layer is preferably formed, for example, by using a sheet-shaped layer or by applying or spraying a resin. If a release agent is attached to the surface of the adhesion layer until the reactor 1A (assembly 10) is placed on the installation target, the surface of the adhesion layer will be kept clean, and easy transport is possible.

Embodiment 2

Figure 7:
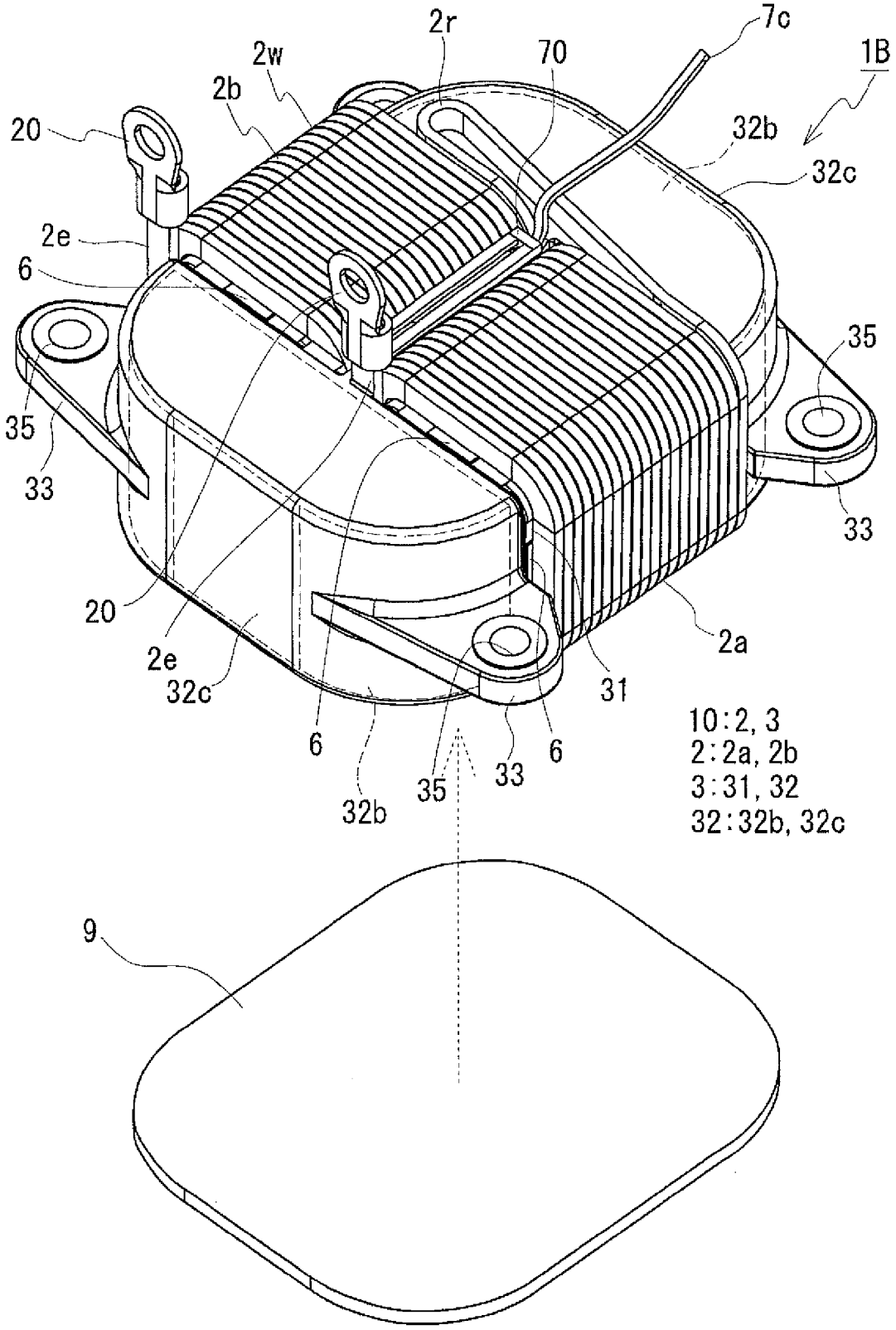
FIG. 7 is a perspective view schematically illustrating a reactor according to Embodiment 2.

Embodiment 2 will describe an aspect in which the reactor 1A of Embodiment 1 further include a heatsink 9. A reactor 1B in FIG. 7 according to Embodiment 2 is the same as the foregoing reactor 1A of Embodiment 1 in the basic configurations such as the coil 2 and the magnetic core 3 including the heat dissipating sheets and the coil fixing sections 6, except for the heatsink 9, and thus the following will describe mainly the difference.

Heatsink

The heatsink 9 can be arranged at a desired position of the coil 2 that generates heat at the time of use of the reactor, and may be arranged for example on the installation target-side surface of the coil 2, that is, on the installation surface of the coil 2. With the reactor 1B shown in FIG. 7, the heatsink 9 is arranged on the lower surface of the coil 2, and this heatsink 9 will be interposed between the coil 2 and the installation target (not shown).

The material of which the heatsink 9 is made may be a material with superior thermal conductivity, and specifically a metal material such as aluminum or an aluminum alloy, magnesium or a magnesium alloy, copper or a copper alloy, silver or a silver alloy, iron, or an austenitic stainless steel, or a ceramic material such as silicone nitride, alumina, aluminum nitride, boron nitride, silicon carbide, or mullite, or the like. Metal materials ordinarily have superior thermal conductivity, and particularly aluminum or magnesium alloys are lightweight, and are appropriate for a material for in-car components. Furthermore, aluminum and alloys thereof have an advantage in excellent processability, heat-dissipation performance, and corrosion resistance, and magnesium and alloys thereof have an advantage in excellent vibration suppression performance. The thickness of the heatsink 9 may be selected as suitable, and may be, for example, at least 2 mm and not greater than 5 mm.

The heatsink 9 needs only to have a size that corresponds to the installation surface (that is, the lower surface) of the coil 2, and the size and the shape of the heatsink 9 may be selected as suitable. The heatsink 9 shown in this example is a substantially rectangular flat plate having a size that covers not only the lower surface of the coil 2 but also the lower surface of the assembly 10 constituted by the coil 2 and the magnetic core 3. Accordingly, in the reactor 1B, it is possible to transfer not only the heat of the coil 2 well, but also the heat of the magnetic core 3 (outer core sections 32) to the installation target. Furthermore, by being made larger than the lower surface of the assembly 10, the heatsink 9 can function as a seat for supporting the assembly 10 as a single piece, and there is the advantage that the reactor can easily be carried and handled. If the heatsink 9 is made larger than the lower surface of the assembly 10, the heatsink 9 preferably has through-holes or notches (not shown) on its four corners, for example, in order not to interfere with bolts for fixing to the installation target, or with boss sections formed on the installation target.

The heatsink 9 can be fixed to the lower surface of the assembly 10 (coil 2) by, for example, the above-described adhesion layer. By fixing the heatsink 9 to the coil 2 using the adhesion layer, the contact state between the heatsink 9 and the coil 2 is easily maintained, and the heat of the coil 2 is easily transferred to the heatsink 9. Furthermore, a heat dissipating sheet (not shown) may be arranged between the heatsink 9 and the assembly 10 (coil 2).

Operational Effects

The reactor 1B of Embodiment 2 includes the heatsink 9, which can be used for the heat dissipation path of the coil 2, and thus achieves higher heat-dissipation performance, in addition to the above-described operational effects of the reactor 1A of Embodiment 1.

Embodiment 3

Embodiment 1 has described an embodiment in which the coil fixing sections 6 for restricting the movement of the coil 2 are provided. In Embodiment 3, a configuration in which the heat dissipating sheets 4 also have the function to restrict the movement, of the coil 2 will be described with reference to FIGS. 8A to 10. Note that a reactor 1C of Embodiment 3 is the same as the above-described reactor 1A of Embodiment 1 in the basic configuration in which the heat dissipating sheets 4 are arranged between the coil 2 and the inner core sections 31, and thus the following will mainly describe differences.

Heat Dissipating Sheet

The heat dissipating sheets 4 shown in this example are made of a rubber material (elastic material), and are elastically deformed while being sandwiched between the coil 2 and the inner care sections 31. In other words, the heat dissipating sheets 4 are interposed between the inner circumferential surfaces of the coil 2 (wound sections 2*a* and 2*b*) and the outer circumferential surfaces of the inner core sections 31 while being elastically deformed, and press the inner circumferential surfaces of the coil 2 (wound sections 2*a* and 2*b*) in the radial direction by being elastically deformed, so as to restrict the movement of the coil 2 (wound sections 2*a* and 2*b*) with the pressing force.

Figure 9:
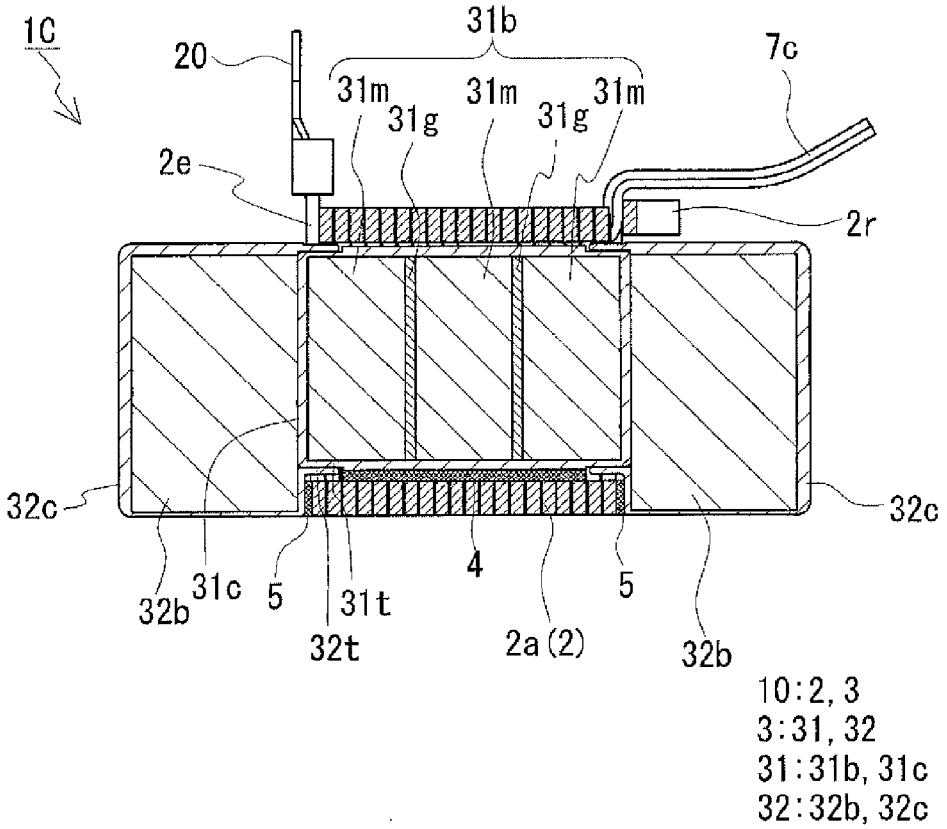
FIG. 9 is a vertical cross-sectional view schematically illustrating the reactor according to Embodiment 3.
Figure 10:
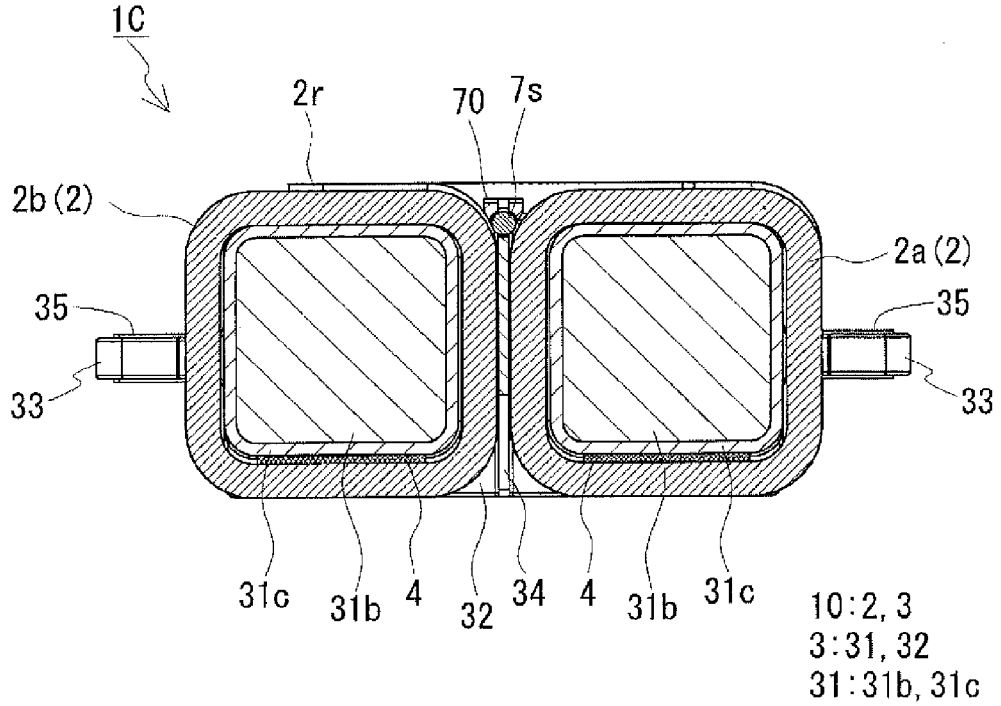
FIG. 10 is a horizontal cross-sectional view schematically illustrating the reactor according to Embodiment 3.

In this example, similar to the reactor 1A of Embodiment 1, each heat dissipating sheet 4 is arranged on the installation target-side surface (that is, the lower surface), which is opposite to the installation target, of the outer circumferential surface (four planes) of the inner core section 31 (see FIGS. 9 and 10). The shape of the heat dissipating sheet 4 is the same as that of the lower surface of the inner core section 31. Furthermore, in this example, in contrast to the reactor 1A of Embodiment 1, the entire outer circumferential surface of the middle body section 31*b* of the inner core section 31 is covered with the middle resin molded section 31*c*.

As shown in this example, if the heat dissipating sheet 4 is arranged on the lower surface of the inner core section 31, the heat dissipating sheet 4 will press the inner circumferential surface of the coil 2 downward, and the opposite upper surface of the inner circumferential surface of the coil 2 is pressed against the inner core section 31. In this example, the heat dissipating sheets 4 are arranged on the lower surfaces of the inner core sections 31, but the present disclosure is not limited to this, and the heat dissipating sheets 4 may also be arranged on the upper and side surfaces of the inner core sections 31. In any case, the repelling force (or counterforce) of the heat dissipating sheets 4 increases the normal force exerted between the inner circumferential surfaces of the coil 2 and the outer circumferential surfaces of the inner core sections 31, resulting in an increase in the frictional force between the coil 2 and the inner core sections 31. Accordingly, the movement of the coil 2 with respect to the magnetic core 3 (inner core sections 31) in the radial and circumferential directions can be restricted, and the movement in the axial direction is also restricted.

The contact area between the heat dissipating sheets 4 and the inner circumferential surfaces of the coil 2 (wound sections 2*a* and 2*b*) increases with an increase in the length of the heat dissipating sheets 4 and an increase in the width of the heat dissipating sheets 4, and the movement of the coil 2 is easily restricted. As shown in this example, if each heat dissipating sheet 4 is arranged along the axial direction (direction from one end surface to the other end surface) of the inner core section 31, an increase in the contact area will facilitate to press the inner circumferential surface of the coil 2 uniformly in the axial direction. The heat dissipating sheets 4 are preferably arranged at symmetrical positions in the axial and width directions of the inner core sections 31 so as to easily press the inner circumferential surfaces of the coil 2 (wound sections 2*a* and 2*b*) in the radial direction.

Each heat dissipating sheet 4 has such a thickness that the heat dissipating sheet 4 can fill up a clearance between the inner circumferential surface of the coil 2 (wound section 2*a*, 2*b*) and the outer circumferential surface of the inner core section 31, and may have a thickness to the extent that the heat dissipating sheet 4 can sufficiently press the inner circumferential surface of the coil 2. In the state before arrangement between the inner circumferential surface of the coil 2 and the outer circumferential surface of the inner core section 31, the heat dissipating sheet 4 is thicker than the clearance, and in the state after the arrangement between the inner circumferential surface of the coil 2 and the outer circumferential surface of the inner core section 31, the heat dissipating sheet 4 is compressed and deformed while being sandwiched between the coil 2 and the inner core section 31. The thickness of the heat dissipating sheets 4 may suitably be chosen according to the clearance between the inner circumferential surface of the coil 2 and the outer circumferential surface, of the inner core section 31, the rubber hardness of the rubber material from which the heat dissipating sheets 4 are made, or the like. If, as shown in this example, the heat dissipating sheet 4 is arranged on one side of the outer circumferential surface of each inner core section 31, the thickness of the heat dissipating sheet 4 may be, for example, at least 1.5 times and not more than 3 times larger than twice the clearance. If the heat dissipating sheets 4 are arranged on two opposite surfaces of the outer circumferential surface of the inner core section 31, the thickness of each heat dissipating sheet 4 may be at least 1.5 times and not more than 3 times larger than the clearance.

As described above, if the heat dissipating sheets 4 are arranged in the axial direction of each inner core section 31, and are arranged on a plurality of surfaces, particularly, all the surfaces of the outer circumferential surface of the inner core section 31, it may be difficult to insert the heat dissipating sheets 4 between the inner circumferential surface of the coil 2 and the outer circumferential surfaces of the inner core section 31. Accordingly, it is preferable that the heat dissipating sheet 4 be arranged only on one side of the outer circumferential surface of the inner core section 31.

Figure 11:
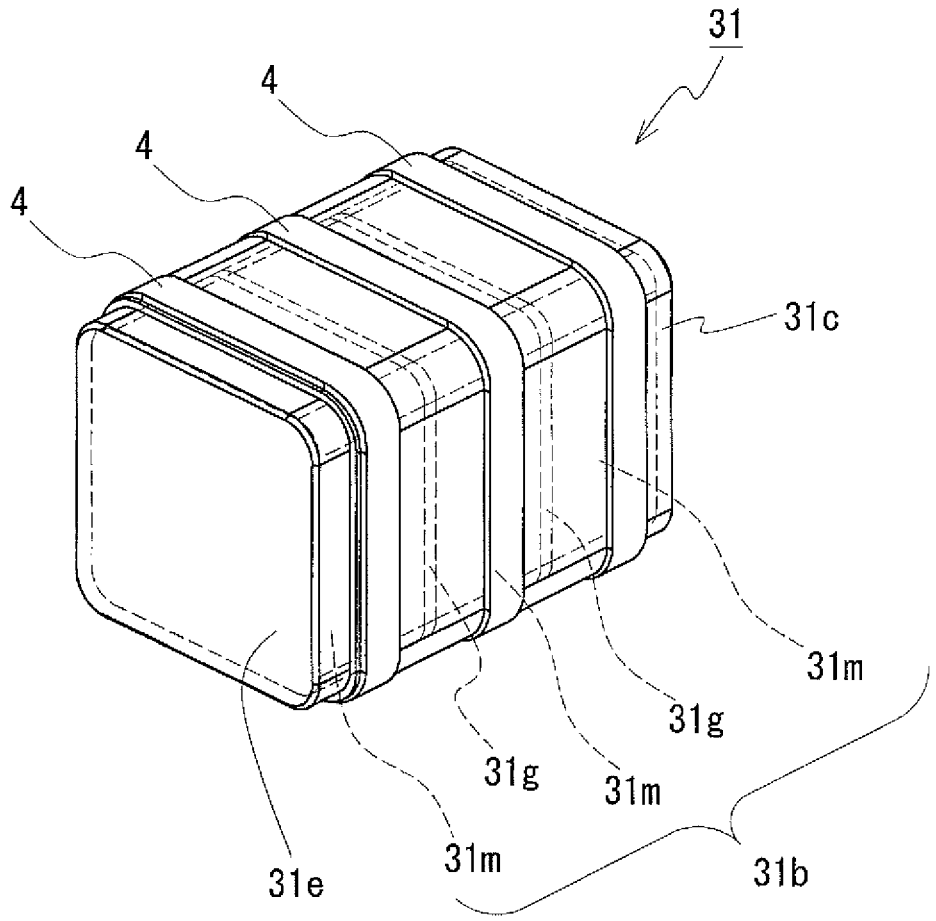
FIG. 11 is a perspective view schematically illustrating a modification of heat dissipating sheets included in the reactor according to Embodiment 3.
Figure 12:
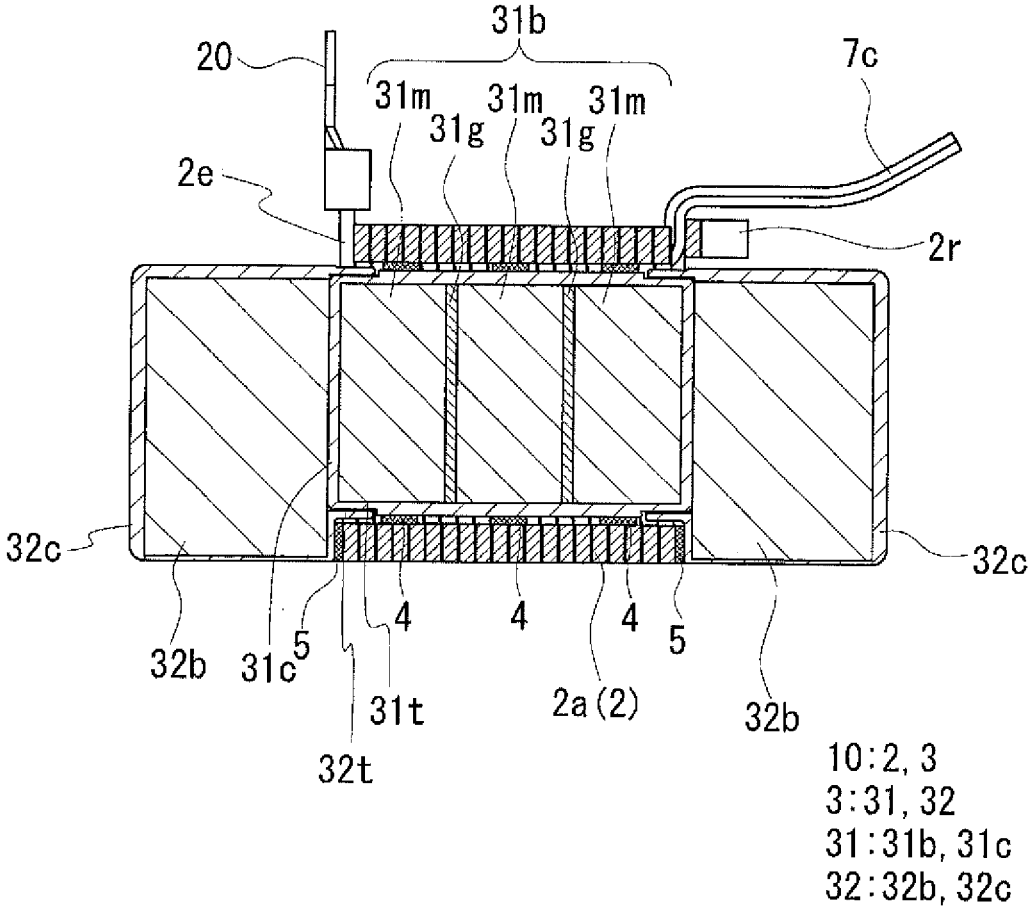
FIG. 12 is a vertical cross-sectional view schematically illustrating a modification of the heat dissipating sheets included in the reactor according to Embodiment 3.

In the above-described example, a case in which the heat dissipating sheets 4 are arranged in the axial direction of the inner core sections 31 has been described. As another arrangement of the heat dissipating sheets 4, a configuration is also possible in which the heat dissipating sheets 4 are arranged partially in the axial direction of the inner core sections 31, and on all outer circumferential surfaces of the inner core sections 31. For example, as shown in FIGS. 11 and 12, a plurality of ring-shaped heat dissipating sheets 4 may be arranged at intervals in the axial direction of the inner core section 31. Even if a heat dissipating sheet 4 is arranged in the circumferential direction along the entire outer circumferential surface of the inner core section 31, the repelling force of the heat dissipating sheet 4 increases the normal force exerted between the inner circumferential surface of the coil 2 and the outer circumferential surface of the inner core section 31, resulting in an increase in the frictional force between the coil 2 and the inner core section 31. However, in the case of the ring-shaped heat dissipating sheets 4, the total length of the heat dissipating sheets 4 in the axial direction of the inner core section 31 may be less than 50%, and preferably not more than 40% of the length in the axial direction of the inner core section 31. By reducing the length of the heat dissipating sheets 4 to some extent, even ring-shaped heat dissipating sheets 4 may be inserted relatively easily. The total length of the heat dissipating sheets 4 may be at least 10%, and preferably at least 20% of the length in the axial direction of the inner core section 31, in view of ensuring the contact area to the inner circumferential surface of the coil 2. Furthermore, if the plurality of ring-shaped heat dissipating sheets 4 are arranged at intervals in the axial direction of the inner core section 31, it is preferable that the heat dissipating sheets 4 be arranged in the vicinity of both ends of the inner core section 31, and the remaining heat dissipating sheets 4 be arranged at uniform intervals.

Elastic End Members

Figures 8A, 8B:
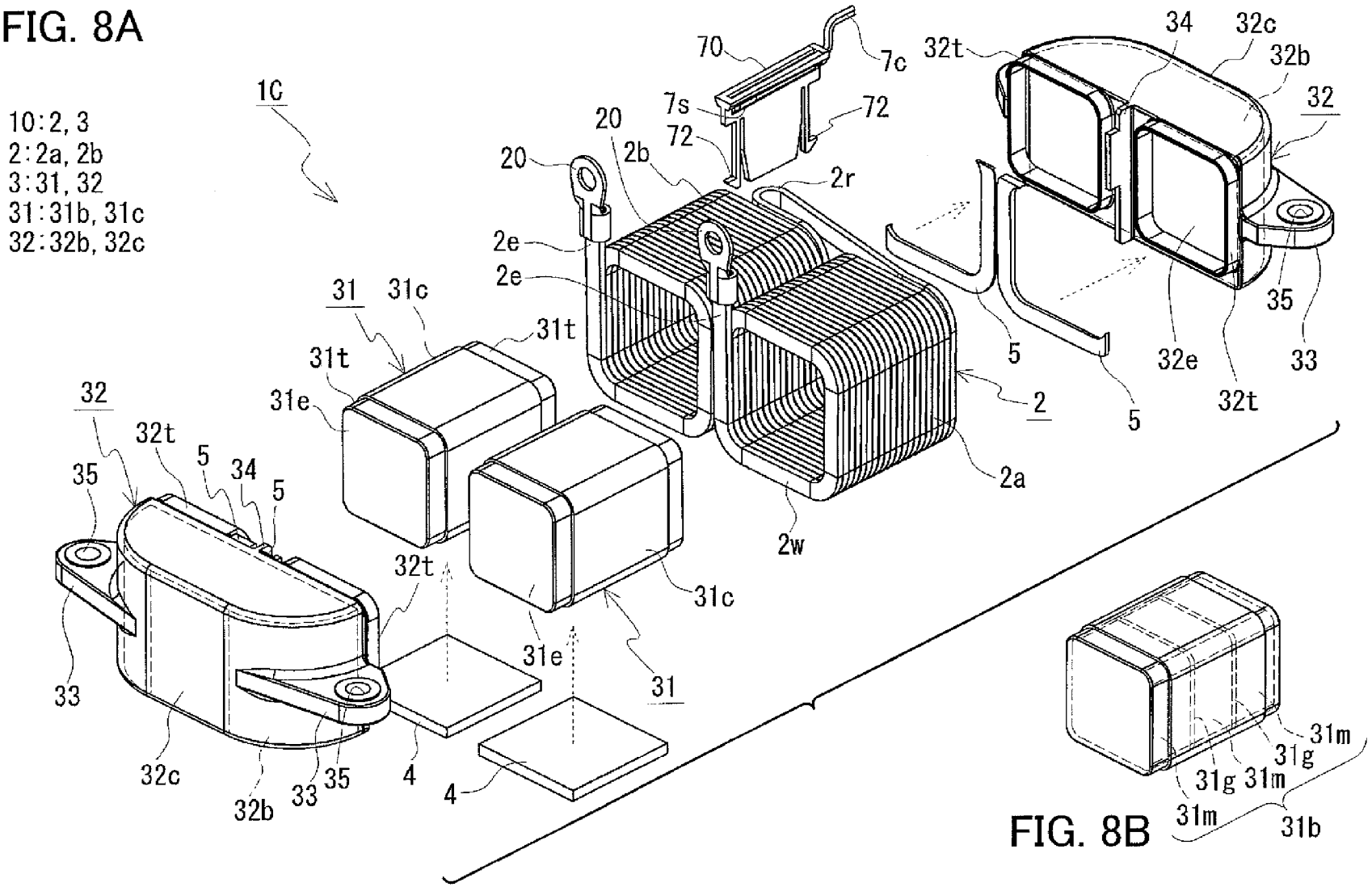
FIGS. 8A and 8B are exploded perspective view schematically illustrating a reactor according to Embodiment 3.

As shown in FIGS. 8A and 8B, the reactor 1C includes elastic end members 5 that are interposed between the coil 2 and the outer core sections 32, and are configured to restrict the movement of the coil 2. The elastic end members 5 are members that are arranged at least partially between the end surface of the coil 2 (wound sections 2*a* and 2*b*) and the inner end surface 32*e* of the outer core section 32 that is opposite to the end surface of the coil 2, and press the end surface of the coil 2 in the axial direction. In this example, a pair of elastic end members 5 are arranged between the end surface of the coil 2 and the inner end surface 32*e* of the outer core section 32, and at positions corresponding to the above-described, coil-opposing regions (see FIG. 5) of the inner end surface 32*e* of the outer core section 32. Furthermore, each elastic end member 5 is an L-shaped plate having the size corresponding to the coil-opposing region. The constituent material of the elastic end members 5 may be the above described rubber material from which the heat dissipating sheets 4 are made. In this example, the elastic end members 5 are made of the same rubber material (elastic material) as the heat dissipating sheets 4.

Any elastic end member 5 may be used as long as it presses the end surface of the coil 2 (wound sections 2*a* and 2*h*) in the axial direction and restricts the movement of the coil 2. As the constituent material of the elastic end members 5, a material with superior electric insulation, and with superior heat resistance against the maximum temperature reached by the coil 2 (that is at least 150° C., and preferably at least 180° C.) is preferably selected, and a material with superior corrosion resistance against the outer environment is more preferably selected. A material that is electrically insulating is preferably selected for the constituent material of the elastic end members 5 since it can ensure insulation between the coil 2 and the outer core sections 32. Furthermore, in view of pressing the coil 2 and restricting the movement of the coil 2, the rubber hardness of the rubber material from which the elastic end members 5 are made is preferably at least 30 and not greater than 70, and more preferably at least 40 and not greater than 60. By the rubber hardness being at least 30 and not greater than 70, and particularly at least 40 and not greater than 60, the elastic end members 5 easily and appropriately press the coil 2 by being compressed and deformed (elastically deformed).

The elastic end members 5 may be arranged at positions that correspond to the coil-opposing regions of the inner end surface 32*e* of at least one outer core section 32. If the elastic end members 5 are arranged at the positions on one outer core section 32 on the connecting section 2*r* side of the coil 2, the elastic end members 5 will press the end surface of the coil 2 on the connecting section 2*r* side, and the end surface of the coil 2 on the coil wire end 2*e* side is pressed against the other outer core section 32. In contrast, if the elastic end members 5 are arranged at the positions on the other outer core section 32 on the coil wire end 2*e* side of the coil 2, the elastic and members 5 will press the end surface of the coil 2 on the coil wire end 2*e* side, and the end surface of the coil 2 on the connecting section 2*r* side is pressed against the other outer core section 32. In any case, the movement of the coil 2 with respect to the magnetic core 3 (inner core section 31) in the axial direction is restricted, and the movement in the radial direction and the circumferential direction are also restricted. If the elastic end members 5 are arranged only between the one end surface of the coil 2 and the inner end surfaces 32*e* of one outer core section 32, the elastic end members 5 are preferably arranged on the connecting section 2*r* side of the coil 2. Since a busbar (not shown) is connected to the coil wire ends 2*r* of the coil 2 via the terminal fittings 5 as described above, the movement of the coil 2 on the coil wire end 2*e* side exerts a stress on the connection positions of the coil wire ends 2*e* and the busbar, which is not preferable. By arranging the elastic end members 5 on the connecting section 2*r* side of the coil 2, the coil wire end 2*e* side of the coil 2 is pressed against the outer core section 32, and thus the movement of the coil 2 on the coil wire end 2*e* side is restricted more easily, and stress is less likely to be exerted on the connection positions. Of course, as shown in this example, the elastic end members 5 may be arranged on both the connecting section 2*r* side of the coil 2 and the coil wire end 2*e* side of the coil 2. In this case, the end surfaces of the coil 2 can be pressed by the elastic end members 5, and the movement of the coil 2 is restricted, preventing the coil 2 from getting in direct contact with the outer core sections 32 and damaging the outer core sections 32.

The elastic end members 5 need only to be an sued in at least part of the coil-opposing regions of the inner end surfaces 32*e* of the outer core sections 32. The larger the length of the elastic end members 5 (length in the circumferential direction of the end surfaces of the wound sections 2*a* and 2*b*) is, the more preferable it is, and the larger the width of the elastic end members 5 (length in the radial direction of the end surfaces of the wound sections 2*a* and 2*b*), the more preferable it is. In the above-described coil-opposing region, the contact area of the elastic end member 5 and the end surface of the coil 2 increases with an increase in the length of the elastic end member 5 and with an increase in the width of the elastic end member 5, and the elastic end member 5 easily and uniformly presses the end surface of the coil 2. Accordingly, the movement of the coil 2 is restricted more easily. It is thus preferable to set the size of the elastic end member 5 to be the same as that of the coil-opposing region.

Each elastic end member 5 has such a thickness that the elastic end member 5 can fill up a clearance between the end surface of the coil 2 (wound section 2*a*, 2*b*) and the inner end surface 32*e* of the outer core section 32, and may have a thickness to the extent that the elastic end member 5 can sufficiently press the end surface of the coil 2. In the state before arranging it between the end surface of the coil 2 and the inner end surface 32*e* of the outer core section 32, the elastic end member 5 is thicker than the clearance, and in the state after arranging it between the end surface of the coil 2 and the inner end surface 32*e* of the outer core section 32, the elastic end member 5 is compressed and deformed. The thickness of the elastic end members 5 may be chosen as suitable according to the clearance between the end surface of the coil 2 and the inner end surface 32*e* of the outer core section 32, rubber hardness of the rubber material from which the elastic end members 5 are made, or the like, and may be, for example, at least 1.5 times and not more than 3 times larger than the clearance. Furthermore, the coil 2 (wound sections 2*a* and 2*b* is obtained by spirally winding the coil wire 2*w*, and the end surface of the coil 2 is inclined. Accordingly, it is preferable that the contact surface of the elastic end member 5 that is in contact with the end surface of the coil 2 be inclined according to the inclination of the end surface of the coil 2, and thereby the elastic end member 5 easily presses the end surface of the coil 2 in the axial direction.

By adhering and fixing each elastic end member 6 to the coil-opposing region of the inner end surface 32*e* of the outer core section 32 or the end surface of the coil 2 (wound sections 2*a* and 2*b*), it is easy to reliably arrange the elastic end member 5 between the end surface of the coil 2 and the inner end surface 32*e* of the outer core section 32. Alternatively, the elastic end members 5 may be ring-shaped plates having a size corresponding to the end surface shape of the coil 2. In this case, a part of the elastic end member 5 is reliably arranged between the end surface of the coil 2 and the inner end surface 32*e* of the outer core section 32. Furthermore, if the ring-shaped elastic end members 5 are used, the inner core sections 31 will respectively be inserted therethrough, and thus the elastic end members 5 are prevented from falling from between the end surface of the coil 2 and the inner end surface 32*e* of the outer core section 32.

In this example, as shown in FIG. 6, each coil-opposing region of the inner end surface 32*e* of the outer core section 32 is an L-shaped region, and is smaller than the end surface of the coil 2 (wound section 2*a*, 2*b*). That is the above-described L-shaped elastic end members 5 press part of the end surface of the coil 2. Accordingly, it is conceivable to increase the contact area between the elastic end members 5 and the end surface of the coil 2 by expanding the coil-opposing regions. Specifically, by protruding the outer core section 32, for example, upward (in the upward direction of FIG. 5) or horizontally (in the horizontal direction of FIG. 5), the inner end surface 32*e* of the outer core section 32 may be expanded in the circumferential direction. This expanded portion of the inner end surface 32*e* may be formed, for example, by the above-described side body section 32*b* itself that constitutes the outer core section 32, or by increasing the thickness of the side resin molded section 32*c*. If the expanded portion of the inner end surface 32*e* is formed by the side resin molded section 32*c*, the inner end surface of the side resin molded section 32*c* may be provided with a flange section (not shown) protruding outward (upward or horizontally) therefrom in the shape of a flange. Accordingly, in the case where ring-shaped elastic end members 5 are used, the contact area between the elastic end members 5 and the end surface of the coil 2 can be ensured as much as possible, and the entire end surface of the coil 2 can be pressed uniformly.

An example of a method for manufacturing the assembly 10 (reactor 1C) including the elastic end members 5 will be described with reference mainly to FIGS. 8A and 8B. In the manufacturing of the assembly 10, when the elastic end members 5 are arranged on one outer core section 32 side, the elastic end members 5 are arranged so as to be sandwiched between one end surface of the coil 2 and the inner end surface 32*e* of one outer core section 32 at the time of connecting one end surface 31*e* of each inner core section 31 to the inner end surface 32*e* of the one outer core section 32. Furthermore, when the elastic end members 5 are arranged on the other outer core section 32 side, the elastic end members 5 are arranged so as to be sandwiched between the other end surface of the coil 2 and the inner end surface 32*e* of the other outer core section 32 at the time of connecting the other end surface 31*e* of each inner core section 31 to the inner end surface 32*e* of the other outer core section 32.

Operational Effects Based on Characteristic Part of Embodiment 3

According to the reactor 1C of Embodiment 3, the heat dissipating sheets 4 have both the function to transfer the heat of the inner core sections 31 to the coil 2 and the function to restrict the movement of the coil 2. Specifically, the heat dissipating sheets 4 are arranged between the inner circumferential surface of the coil 2 and the outer circumferential surface of the inner core sections 31, and by the heat dissipating sheets 4 pressing the coil 2 in the radial direction, the movement of the coil 2 is restricted and the coil 2 is fixed to the magnetic core 3 (inner core section 31). Furthermore, since the coil 2 is pressed in the radial direction, the coil 2 is held in a state in which the distance between the turns of the coil 2 is maintained. Therefore, even if there is no coil fixing section 6 described in Embodiment 1, it is possible to restrict the movement of the coil 2 with respect to the inner core sections 31 in the axial direction, the radial direction, and the circumferential direction due to vibration of the coil 2 and the magnetic core 3 at the time of operation of the reactor, vibration when the vehicle is driving, influence of the outer environment, or the like. Since the movement of the coil 2 is restricted, the coil 2 can be suppressed from colliding or rubbing against the magnetic core 3 (inner core sections 31 and the outer core sections 32) or adjacent turns of the coil 2 can be suppressed from colliding or rubbing against each other. Accordingly it is possible to reduce noise resulting from the collision or rubbing, and damage of the insulating coating of the coil 2. Furthermore, since the movement of the coil 2 is restricted, the connected part of the coil wire end 2*e* and a busbar is hardly subjected to stress, making it possible to suppress the deformation and the damage of the connected part. According to the reactor 1C of Embodiment 3, with the heat dissipating sheets 4, it is possible to improve both the heat-dissipation performance of the inner core section 31 and the fixation of the coil.

Furthermore, according to the reactor 1C of Embodiment 3, the elastic end members 5 are arranged between the end surface of the coil 2 and the inner end surface 32*e* of the outer core section 32, and by the elastic end members 5 pressing the coil 2 in the axial direction, the movement of the coil 2 is restricted, and the coil 2 is fixed to the magnetic core 3 (inner core section 31). Furthermore, the coil 2 is compressed in the axial direction, and is held in a state in which adjacent turns of the coil 2 are in contact with each other. Accordingly the movement of the coil 2 is restricted by not only the heat dissipating sheets 4, but also the elastic end members 5, that is the movement of the coil 2 can be restricted more appropriately by the use of the heat dissipating sheets 4 together with the elastic end members 5.

In the reactor 1C of Embodiment 3, similar to the reactor 1A of Embodiment 1, the coil 2 is fixed to the magnetic core 3 (inner core sections 31), and thus it is not necessary to fix the coil 2 to the magnetic core 3 by covering the assembly 10 with a sealing material or a resin mold, in contrast to the conventional case. Therefore, the sealing material or the like can be omitted, and the outer circumferential surface of the coil 2 can be exposed due to the absence of the sealing material or the like.

Similar to the reactor 1A of Embodiment 1, the reactor 1C of Embodiment 3 in the original state may be attached to an installation target (not shown) such as a cooling base or a converter case, and may be used. Furthermore, the reactor 1C of Embodiment 3 may have a configuration in which the heatsink 9 (FIG. 7) described in Embodiment 2 is provided.

Other Embodiments

Figure 13:
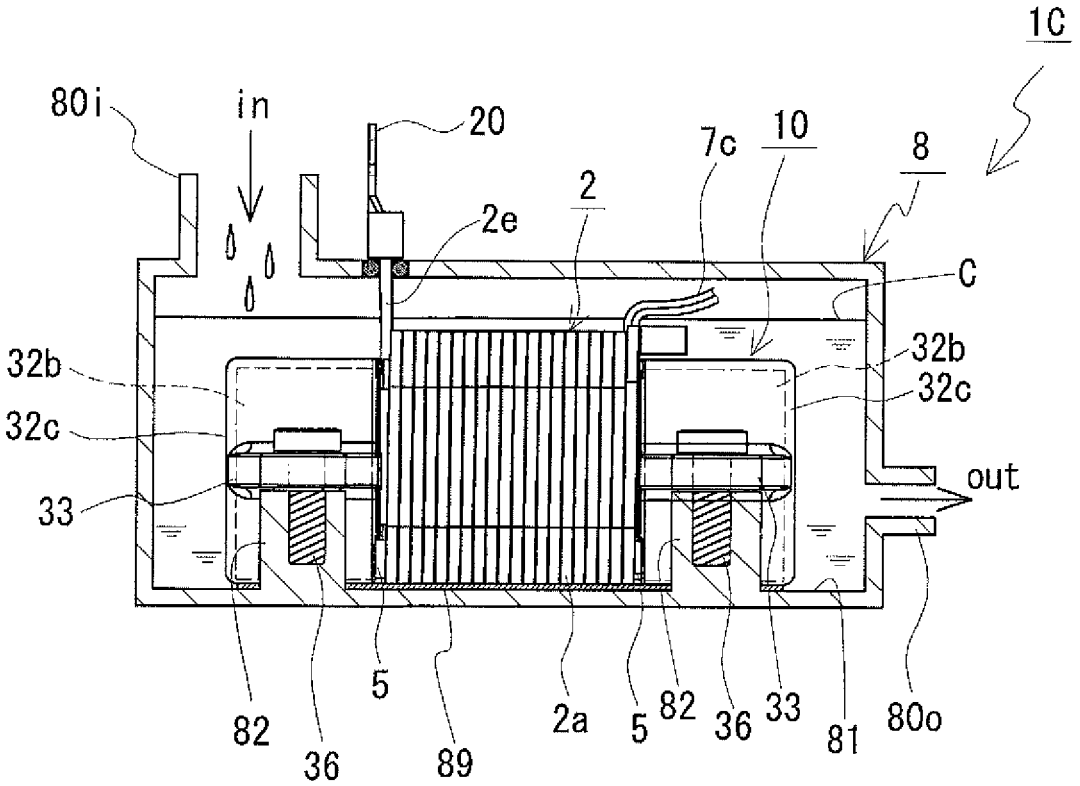
FIG. 13 is a diagram schematically illustrating an example of a use state of the reactor according to Embodiment 3.

The foregoing reactors 1A to 1C of Embodiments 1 to 3 may have an aspect in which a case 8 in which the assembly 10 is accommodated is provided, as shown in, for example, FIG. 13. FIG. 13 shows an aspect in which the reactor 1C is provided with a cooling case 8 in which the assembly 10 is accommodated, and that a liquid coolant C is fed to and discharged from.

Case

The case 8 shown in FIG. 13 includes a feed opening 80*i* through which the liquid coolant C is fed into the case 8, and a discharge opening 80*o* through which the liquid coolant C is discharged from the case 8, and thus the liquid coolant C can be fed and discharged. In this example, it is configured such that the liquid coolant C discharged from the discharge opening 80*o* is cooled by a cooling device (not shown) or the like, and is again fed from the feed opening 80*i* to the case 8 in a circulating manner. Furthermore, as shown in FIG. 13, the feed amount of the liquid coolant C from the feed opening 80*i* and the discharge amount of the liquid coolant C from the discharge opening 80*o* are controlled so that the assembly 10 is always immersed in the liquid coolant C.

The case 8 shown in FIG. 13 is a rectangular box-shaped container, and has a mounting surface 81 on which the assembly 10 is installed. In this example, the inner bottom surface serves as the mounting surface 81. Furthermore, the mounting surface (inner bottom surface) 81 has a region in which the assembly 10 is placed; and boss sections 82 at positions that correspond to the above-described mounting sections 38 formed on the side resin molded sections 32*c* of the outer core sections 32. The total number of the boss sections 82 is four in conformity with the number of the mounting sections 33. Also, the assembly 10 can be fixed in the case 8 by inserting and screwing bolts 33 into bolt holes formed in the collars 35 (see FIGS. 1, 7, 8A and 8B) and in the boss sections 82 of the mounting sections 33. By the bottom plate of the case 8 including the boss sections 82, it is possible to ensure the sufficient fastening length of the bolts 36 without increasing the thickness of the entire bottom plate.

The material of the case 8 may be a metal material such as aluminum or an aluminum alloy, magnesium or a magnesium alloy, copper or a copper alloy, silver or a silver alloy, iron, or an austenitic stainless steel. Metal materials ordinarily have superior thermal conductivity, and particularly aluminum or magnesium alloys are lightweight, and are appropriate as a material for in-car components. Furthermore, aluminum and alloys thereof have an advantage in excellent processability, heat-dissipation performance, and corrosion resistance, and magnesium and alloys thereof have an advantage in excellent vibration suppression performance.

Liquid Coolant

The liquid coolant C may appropriately be a coolant that does not change its form (a coolant that does not gasify) at the maximum temperature reached at the time of use of the reactor. Specifically, a fluorinated inert fluid such as ATF (Automatic Transmission Fluid), which is a lubricant oil for an automatic transmission, and Fluorinert (registered trademark), a fluorocarbon coolant such as HCFC-123 or HFC-134a, an alcoholic coolant such as methanol or alcohol, or a ketone coolant such as acetone can be used. In the use of the reactor in an in-car component that is to be installed in a hybrid automobile or the like, for example, the ATF can be used, and the liquid coolant C does not need to be prepared separately.

Adhesion Layer

As shown in FIG. 13, the installation target-side surface (that is, the lower surface) of the assembly 10 may be provided with an adhesion layer 89 as described above. The adhesion layer 89 shown in FIG. 13 is interposed between the lower surface of the assembly 10 (the lower surfaces of the two outer core sections 32 and the lower surface of the coil 2), and the mounting surface 81 of the case 8. With this adhesion layer 89, both the fixation by the bolts 36 and the firm fixation of the assembly 10 are possible.

Particularly, in this example, since the lower surface of the assembly 10 is substantially planar as described above, the assembly 10 can get into surface contact with the mounting surface 81 of the case 8, and the assembly 10 is reliably fixed. Furthermore, since the lower surface of the assembly 10 is planar, it is possible to sufficiently ensure the contact area with the adhesion layer 89, making it easy to transfer the heat of the assembly 10 (coil 2) to the case 8. In this case, since the coil 2 is fixed to the mounting surface 81 of the case 8, which is an installation target, by the adhesion layer 89, it is possible to restrict the movement of the coil 2 more appropriately, in addition to the effect of restricting the movement of the coil 2 by the coil fixing sections 6 described in Embodiment 1, the heat dissipating sheets 4 described in Embodiment 3, etc. In other words, since the movement of the coil 2 restricted by the coil fixing sections 6, the heat dissipating sheets 4, or the like, the coil 2 can be suppressed from being removed from the adhesion layer 89.

By accommodating the assembly 10 in the above-described cooling case 8, it is possible to forcibly cool the assembly 10 with the liquid coolant C. Particularly, in the reactors 1A to 1C of Embodiments 1 to 3, the outer circumferential surface of the coil 2 can be exposed while the coil 2 is fixed by the coil fixing sections 6, the heat dissipating sheets 4, or the like, and the coil 2 can be brought into direct contact with the liquid coolant C. Accordingly, the heat dissipation effect by the liquid coolant is efficiently exerted, making it possible to enhance the heat-dissipation performance of the coil, and thus the heat-dissipation performance of the reactor.

In Embodiments 1 to 3, descriptions have been given taking the reactors provided with the coil 2 that includes two wound sections 2*a* and 2*b* as specific examples, but the coil can be changed to a coil that includes, for example, only one wound section.

The foregoing reactors of Embodiments 1 to 3 can be used under the energization conditions of, for example, a maximum current (direct current) of about 100A to 1000A, an average voltage of about 100V to 1000V, and a rated frequency of about 5 kHz to 100 kHz, representatively, for constituent components of converters that are installed in vehicles such as electric automobiles or hybrid automobiles, or constituent components of electric power conversion systems including such a converter.

INDUSTRIAL APPLICABILITY

The reactor of the present disclosure is appropriately applicable to constituent components of various converters, such as in-car converters (representatively, DC-DC converters) that are installed in vehicle such as hybrid automobiles, plug-in hybrid automobiles, electric automobiles, and fuel-cell automobiles, and converters of air conditioners, and constituent components of electric power conversion systems.

The invention claimed is:

1. A reactor comprising:

a coil made of a wound coil wire;

a magnetic core on which the coil is arranged, and that forms a closed magnetic path, wherein the magnetic core has an inner core section that is arranged on an inside of the coil; and a heat dissipating sheet that is interposed at least partially between an inner circumferential surface of the coil and an outer circumferential surface of the inner core section that is opposite to the inner circumferential surface of the coil, wherein:

the heat dissipating sheet is in contact with the coil and the inner core section and the heat dissipating sheet is only at a lower surface of the inner core section, and the inner core section includes a middle body section forming the magnetic path, and a middle resin molded section that covers at least a part of an outer circumferential surface of the middle body section.

2. The reactor according to claim 1, wherein the heat dissipating sheet is arranged on at least a part of an installation target-side surface of the outer circumferential surface of the inner core section, the installation target-side surface being opposite to an installation target.

3. The reactor according to claim 1, wherein the heat dissipating sheet is made of an elastic material, and is elastically deformed while being sandwiched between the coil and the inner core section.

4. The reactor according to claim 1, further comprising:

a coil fixing section that is made of a foamed resin, and restricts movement of the coil using a pressing force caused by volume expansion of the foamed resin, wherein:

the coil fixing section is interposed between the inner circumferential surface of the coil and the outer circumferential surface of the inner core section that is opposite to the inner circumferential surface of the coil, and is disposed on at least a part of a section of the outer circumferential surface of the inner core section on which the heat dissipating sheet is not arranged, and the coil fixing section includes an inwardly interposed portion that is interposed between the inner circumferential surface of the coil and the outer circumferential surface of the inner core section, and a turn interposed portion that is interposed between turns of the coil.

5. The reactor according to claim 1, wherein:

in the inner core section, an installation target-side surface, which is opposite to an installation target, of the outer circumferential surface of the middle body section is exposed without being covered with the middle resin molded section, and the heat dissipating sheet is arranged on the installation target-side surface on which the middle body section of the inner core section is exposed.

6. The reactor according to claim 2, wherein the heat dissipating sheet is made of an elastic material, and is elastically deformed while being sandwiched between the coil and the inner core section.

7. The reactor according to claim 2, further comprising:

a coil fixing section that is made of a foamed resin, and restricts movement of the coil using a pressing force caused by volume expansion of the foamed resin, wherein:

the coil fixing section is interposed between the inner circumferential surface of the coil and the outer circumferential surface of the inner core section that is opposite to the inner circumferential surface of the coil, and is disposed on at least a part of a section of the outer circumferential surface of the inner core section on which the heat dissipating sheet is not arranged, and the coil fixing section includes an inwardly interposed portion that is interposed between the inner circumferential surface of the coil and the outer circumferential surface of the inner core section, and a turn interposed portion that is interposed between turns of the coil.

8. The reactor according to claim 3, further comprising:

a coil fixing section that is made of a foamed resin, and restricts movement of the coil using a pressing force caused by volume expansion of the foamed resin, wherein:

the coil fixing section is interposed between the inner circumferential surface of the coil and the outer circumferential surface of the inner core section that is opposite to the inner circumferential surface of the coil, and is disposed on at least a part of a section of the outer circumferential surface of the inner core section on which the heat dissipating sheet is not arranged, and the coil fixing section includes an inwardly interposed portion that is interposed between the inner circumferential surface of the coil and the outer circumferential surface of the inner core section, and a turn interposed portion that is interposed between turns of the coil.

9. The reactor according to claim 6, further comprising:

a coil fixing section that is made of a foamed resin, and restricts movement of the coil using a pressing force caused by volume expansion of the foamed resin, wherein:

the coil fixing section is interposed between the inner circumferential surface of the coil and the outer circumferential surface of the inner core section that is opposite to the inner circumferential surface of the coil, and is disposed on at least a part of a section of the outer circumferential surface of the inner core section on which the heat dissipating sheet is not arranged, and the coil fixing section includes an inwardly interposed portion that is interposed between the inner circumferential surface of the coil and the outer circumferential surface of the inner core section, and a turn interposed portion that is interposed between turns of the coil.

* * * * *